US005351814A

United States Patent [19]

Apps

[11] Patent Number: 5,351,814

[45] Date of Patent: Oct. 4, 1994

[54] STACKABLE CASE FOR BOTTLES

[75] Inventor: William P. Apps, Aneheim, Calif.

[73] Assignee: Rehrig-Pacific Company, Inc., Los Angeles, Calif.

[21] Appl. No.: 936,707

[22] Filed: Aug. 28, 1992

[51] Int. Cl.[5] ..... B65D 75/00; B65D 21/00

[52] U.S. Cl. ..... 206/139; 206/145; 206/203; 206/427; 206/511; 220/519

[58] Field of Search ..... 206/139, 145, 160, 201, 206/203, 427, 433, 430, 508, 509, 511; 220/516, 519

[56] References Cited

U.S. PATENT DOCUMENTS

| | | | |
|---|---|---|---|
| D. 149,519 | 5/1948 | Reynolds . | |
| 820,445 | 5/1906 | Speer . | |
| 895,209 | 5/1907 | Smith . | |
| 2,673,658 | 3/1954 | Stevenson . | |
| 2,830,729 | 4/1958 | Brackett . | |
| 2,885,137 | 5/1959 | Guyer . | |
| 2,995,272 | 8/1961 | Larson . | |
| 3,058,643 | 10/1962 | Wilson . | |
| 3,092,284 | 6/1963 | Stout | 220/519 X |
| 3,297,191 | 1/1967 | Eastman | 220/519 X |
| 3,338,406 | 8/1967 | Anderson | 206/139 |
| 3,349,943 | 10/1967 | Box | 220/519 |
| 3,425,544 | 2/1969 | Ayer et al. . | |
| 3,517,852 | 6/1970 | Schoeller . | |
| 3,643,812 | 2/1972 | Mander et al. . | |
| 3,650,395 | 3/1972 | Hobbs | 206/139 |
| 3,743,167 | 7/1973 | Russell . | |
| 3,752,385 | 8/1973 | Woodgate . | |
| 3,812,996 | 5/1974 | Bunnell . | |
| 3,815,808 | 6/1974 | Bunnell . | |
| 3,982,654 | 9/1976 | Gottseger | 220/519 |
| 3,998,327 | 12/1976 | Box | 206/508 |
| 3,998,328 | 12/1976 | Box | 206/511 |
| 4,036,362 | 7/1977 | Ullman . | |
| 4,037,722 | 7/1977 | Bremer . | |
| 4,303,153 | 12/1981 | Boulton . | |
| 4,410,099 | 10/1983 | deLarosiere . | |
| 4,499,997 | 2/1985 | Swingley, Jr. . | |
| 4,567,981 | 2/1986 | Headon . | |
| 4,609,101 | 9/1986 | Ullman . | |
| 4,625,864 | 12/1986 | Nigrelli . | |
| 4,625,908 | 12/1986 | Emery . | |
| 4,823,955 | 4/1989 | Apps . | |
| 4,899,874 | 2/1990 | Apps et al. . | |
| 4,911,300 | 3/1990 | Colonna . | |
| 5,009,053 | 4/1991 | Langenbeck et al. . | |
| 5,031,761 | 7/1991 | deLarosiere . | |
| 5,038,961 | 8/1991 | Watanabe et al. . | |
| 5,184,748 | 2/1993 | Apps | 220/519 |

FOREIGN PATENT DOCUMENTS

| | | |
|---|---|---|
| 2819678 | 11/1979 | Fed. Rep. of Germany . |
| 1224622 | 12/1960 | France . |
| WO90/15758 | 12/1990 | PCT Int'l Appl. . |
| 1115343 | 5/1968 | United Kingdom . |
| 2220196A | 4/1990 | United Kingdom . |

*Primary Examiner*—Bryon P. Gehman

*Attorney, Agent, or Firm*—Banner, Birch, McKie & Beckett

[57] ABSTRACT

A stackable bottle case including a tray having a floor structure with a plurality of bottle support areas on an upper surface thereof and a plurality of upward recesses on a lower surface thereof, and a tray cover positionable in a covering position over the bottles supported on the support areas. The tray cover has a cover top structure which includes a bottom side, with a plurality of downward receivers in which the tops of the bottles on the support areas are received when the tray cover is in the covering position, and a top side, with a plurality of protuberances that are positioned to lockingly fit in the upward recesses on the lower surface of a similar stackable bottle tray which is stacked on the tray cover.

52 Claims, 25 Drawing Sheets

STACKABLE CASE FOR BOTTLES

BACKGROUND OF THE INVENTION

The present invention relates to a stackable case for transporting and storing beverage containers, such as twelve ounce and sixteen ounce glass bottles and the like, and in particular, to trays for bottles and covers adapted specifically therefor.

Bottles for soft drinks, beer and other beverages are often stored and transported during the distributing stages thereof in short-walled cardboard trays or in cardboard boxes. These cardboard structures are generally not rugged enough for reuse and therefore must be broken down and discarded by the retailer at his expense. This not only creates a costly and labor intensive process for the retailer, but also contributes to the problem of environmental waste and the already overfilled landfills. In addition, paperboard cartons are flimsy and can collapse when wet. They are also unattractive and generally do not permit the full displaying, merchandising and advertising of the bottled beverage.

An example of a prior art cardboard case is disclosed in U.S. Pat. No. 3,752,385 to Woodgate. This case additionally provides a plastic divider which, when placed in the cardboard case, forms separate bottle receiving compartments. The plastic divider, however, does not overcome the aforementioned disadvantages generally associated with paperboard boxes. Thus, there has been a need for a returnable and reusable case for storing and transporting bottles and the like. This case should be light weight, easy to manipulate and carry, able to hold and separate at least two different sized bottles, and economically constructed, since the non-reusable cardboard boxes which it replaces generally cost less than a dime to use. Additionally, it is also preferable to have a case which completely encloses the bottles, thereby preventing the deterioration of the beverage therein which may be caused by exposure to sunlight.

Reusable plastic trays have been developed for transporting and storing bottles such as two-liter beverage bottles. An example of a recent plastic, nesting and stacking storage container is that disclosed in U.S. Pat. No. 4,823,955 of the present assignee. These trays often have a height which is greater than the height of the bottles contained therein such that when stacked the trays do not rest on top of the bottles in the lower tray. Rather, the sides of the trays bear the loads of the upper trays and their contents. These trays do not have covers and thus do not completely enclose the bottles therein. They are also expensive to manufacture, to ship and to store empty as they are relatively large and occupy a large amount of space.

In response to the demand for a more conveniently sized tray, plastic low depth trays have been developed wherein the side walls are lower than the height of the stored bottles. The bottles contained in a lower tray thereby support the weight of the other trays stacked on top of them, and this is particularly well suited for today's plastic, polyethylene terephthalate (PET) bottles. PET bottles have become particularly popular because of their transparency, light weight and low cost. Even though they are flexible, their walls are strong in tension and thus can safely contain the pressure of the carbonated beverages in them. Their flexible walls can also bear surprisingly high compressive loads, as long as these loads are applied axially. Thus, it is important that the bottles do not tip in these trays, as the loads thereon when stacked would then not be along the longitudinal axes of the bottles, and the loaded bottles would thereby be caused to buckle. This is particularly true for the larger capacity PET bottles, such as the two-liter bottles widely used for soft drinks today.

One commercially successful design of the stackable low depth tray particularly suitable for the two-liter PET bottles is the "Castle Crate" design of the present assignee, such as is disclosed in U.S. Pat. No. 4,899,874. For this genre of trays a plurality of columns project upwardly from the bottom crate portion and together with the side walls help define a plurality of bottle retaining pockets. These columns are hollow to permit empty crates to stack top to bottom. These low-profile crate designs have spaced side columns to provide added strength and yet still expose the containers therein. However, since no cover is provided these crate designs do not provide an enclosed case which prevents sunlight deterioration of the beverage within the bottles.

Beverage cans are often sold, as in convenience stores, loose or individually, that is, not in an attached six-pack arrangement. To meet the demand of being able to easily remove individual cans from a case, trays for beverage cans have been developed such as those disclosed in U.S. Pat. No. 5,031,774 to Morris et al., U.S. Pat. No. 5,009,053 to Langenbeck et al., and low-depth can trays of the present assignee, as disclosed in copending U.S. application Ser. No. 07/888,479 or PCT International Publication No. WO 90/15758. This tray allows substantial visibility of the cans supported therein while also allowing a single can to be easily removed therefrom. Beverages in twelve or sixteen ounce bottle sizes may also be sold loose or individually. However, to remove the bottles from their six-pack (secondary) packaging, whether a shrink wrap or a cardboard enveloping carton, is a labor intensive procedure which also produces additional waste for disposal. It is desirable, therefore, to provide a bottle case from which bottles may be easily removed and which is reusable.

Some of the known prior art trays, such as that disclosed in U.S. Pat. No. 4,410,099 to de Larosiere, also do not hold their beverage containers in a continuous spaced relation, thus the containers have a tendency to rub against one another or the crate structure while in transport. This action can rub off the container labels or scratch the containers, and presents a particular problem for glass soft drink and beer bottles due to the additional risk of breakage.

Thus, there is a strong need for a reusable and returnable case for bottles which will completely enclose the bottles to prevent the deterioration of their contents due to exposure to external light, hold and separate the bottles to prevent contact between adjacent bottles and with the case, accommodate at least two of the most common sized bottles, be light weight and easy to handle, and be economical to manufacture.

SUMMARY OF THE INVENTION

Accordingly, it is a principal object of the present invention to provide an improved stackable case for storing and transporting containers, such as beverage bottles.

Another object of the present invention is to provide an improved stackable bottle case including a tray for receiving bottles and a tray cover which completely encloses the bottles so as to prevent exposure to external light and the subsequent deterioration of the bottle contents.

A further object of the present invention is to provide an improved stackable bottle case which can accommodate at least two different sized bottles.

A still further object of the present invention is to provide an improved stackable bottle case including a tray which has a plurality of separated bottle pockets to hold loose bottles therein in a compact array while preventing them from rubbing against one another during transport and a cover which engages the tops of these bottles to thereby maintain them in the spaced, upright position.

A still further object of the present invention is to provide a plastic stackable case which is light weight, economical to manufacture and attractive.

Directed to achieving these objects, a novel stackable case for beverage containers is herein provided. This case includes a tray and a cover. The tray is formed by integrally molding from plastic a floor structure, side and end walls, and dividing walls. The floor structure has on its top surface a plurality of fluid container support areas, each for supporting thereon a separate beverage container. The bottom floor surface in turn has a number of receiving areas for receiving therein the cover projections corresponding to the tops of similar fluid containers in a similar case beneath the floor structure. The cover is formed by integrally molding from plastic a ceiling structure and side and end walls. The ceiling structure has on its bottom surface a plurality of separating rings which project downwards and receive therein the tops of the bottles in the tray beneath. The top ceiling surface has a plurality of receiving caps which project upwards and have a closed upper surface. The separating rings and receiving caps are integrally joined and thereby form openings in the ceiling structure which allow the tops of bottles to project above the ceiling structure into the receiving caps.

In one embodiment of the present invention, the tray is a low-depth stackable tray in which the side walls, end walls and dividing walls are approximately the same height. In this embodiment the cover is disposed exterior to the periphery of the side and end walls and extends substantially over the entire depth of the tray, if relatively short bottles are stored in the tray. If taller bottles are stored in the tray, then the cover being raised by the taller bottles will only extend partially over the exterior of the tray walls.

In another embodiment of the present invention, the side and end walls extend above the height of the bottles stored therein and only the dividing walls are low. In this case handles may be provided in the portion of the end walls extending above the height of the bottles to facilitate the lifting thereof. A low-depth cover in this instance is disposed inside of the tray walls without obstructing access to the handles.

In both cases, the tray side and end walls and the cover are formed from nonperforate plastic and when utilized in combination, the resultant case does not permit external light or sunshine to reach the bottle contents. This feature is of particular importance in the beer industry, where light has a deteriorating effect on the alcoholic beverage. Both cases are further capable of being stacked when the receiving areas on the bottom surface of a tray are placed upon the receiving caps of a cover of a subjacent case.

Other objects and advantages of the present invention will become more apparent to those persons having ordinary skill in the art to which the present invention pertains from the following description taken in conjunction with the accompanying drawings.

DETAILED DESCRIPTION OF PREFERRED EMBODIMENTS OF THE INVENTION

Figure 1A:
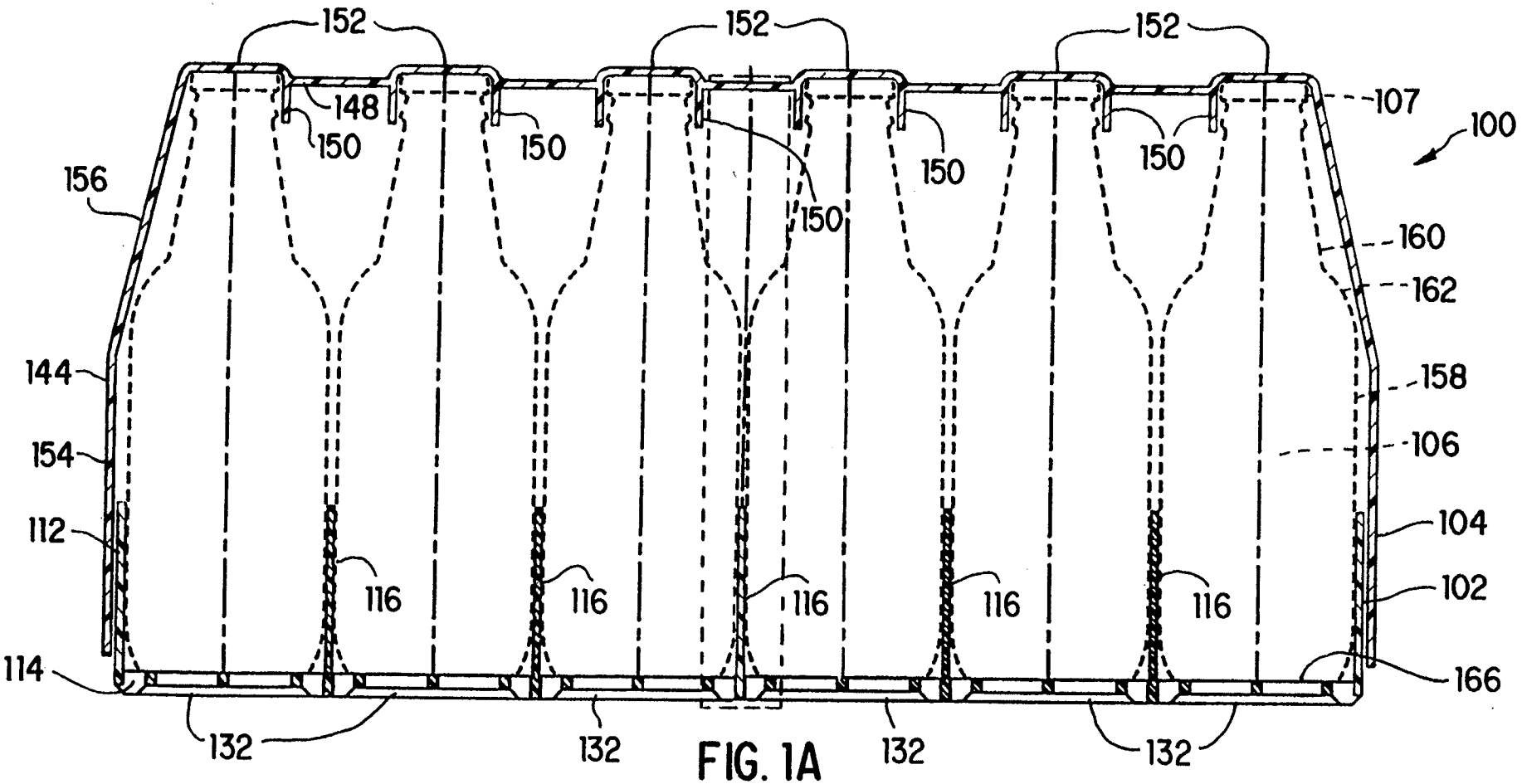
FIG. 1A is a cross-sectional view showing a tray and cover which thereby form a case according to a preferred embodiment of the present invention, when loaded with bottles having a first height and diameter.
Figure 1B:
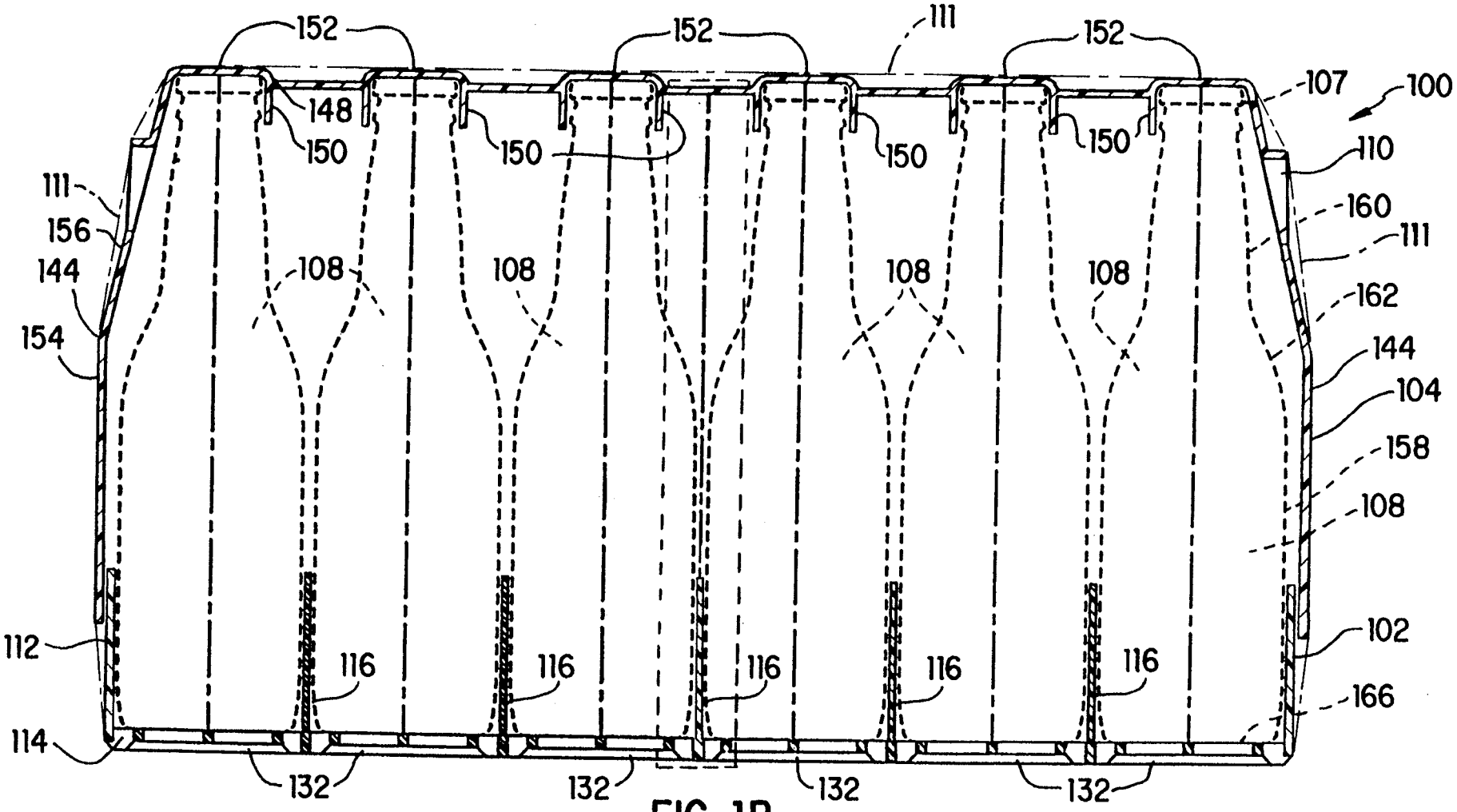
FIG. 1B is a cross-sectional view of the case shown in FIG. 1A when loaded with bottles having a second height and diameter.
Figure 2A:
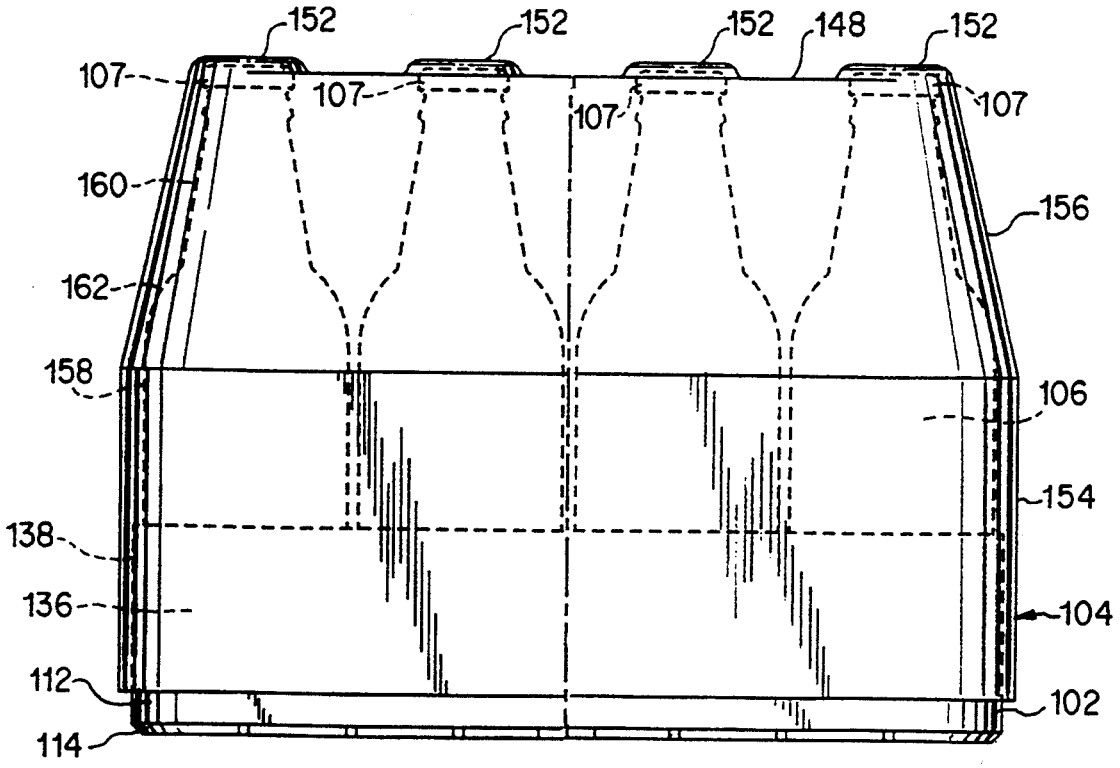
FIG. 2A is an end elevational view of the case of the present invention, as loaded in FIG. 1A.

A number of variations of the present invention are possible, and some of them are illustrated in the drawings. This invention, as will be explained, can be adapted to hold generally any type of fluid container and is especially adaptable for twelve ounce or sixteen ounce bottles, such as those commonly used today in the beer and soft drink industries. A first preferred case embodiment of the present invention is shown in FIGS. 1–11 generally at 100. Case 100 includes a low-depth tray 102 and cover 104 and is especially adapted for holding relatively short and stocky bottles 106 as shown in FIG. 1A, or taller more narrow bottles 108 as shown in FIG. 1B. In both instances, cover 104 is disposed over and exterior to the periphery of tray 102 and thereby encloses the bottles therein. As shown in FIG. 2A, when shorter bottles 106 are stored in tray 102, cover 104 extends substantially over the entire depth of tray 102, as opposed to FIG. 2B, wherein the taller bottles 108 raise cover 104 such that it only extends partially over tray 102. Bottles 106 and 108 comprise similar components, but in different dimensional relationships. That is, both bottle sizes include a generally cylindrical body 158 having a first diameter, a circular bottom member 166 attached to the bottom of cylindrical body 158 to thereby form a container, a tapered neck portion 160, a curved shoulder portion 162 connecting body 158 to neck portion 160, and a circular top lip 164 having a second smaller diameter. A removable bottle top 107 is disposed over lip 164 to sealingly protect the bottle contents from the external environment until the desired consumption time. Top 107 may be removed, for example, by either applying a twisting force in the counter-clockwise direction or with the assistance of a bottle opener.

Figure 2B:
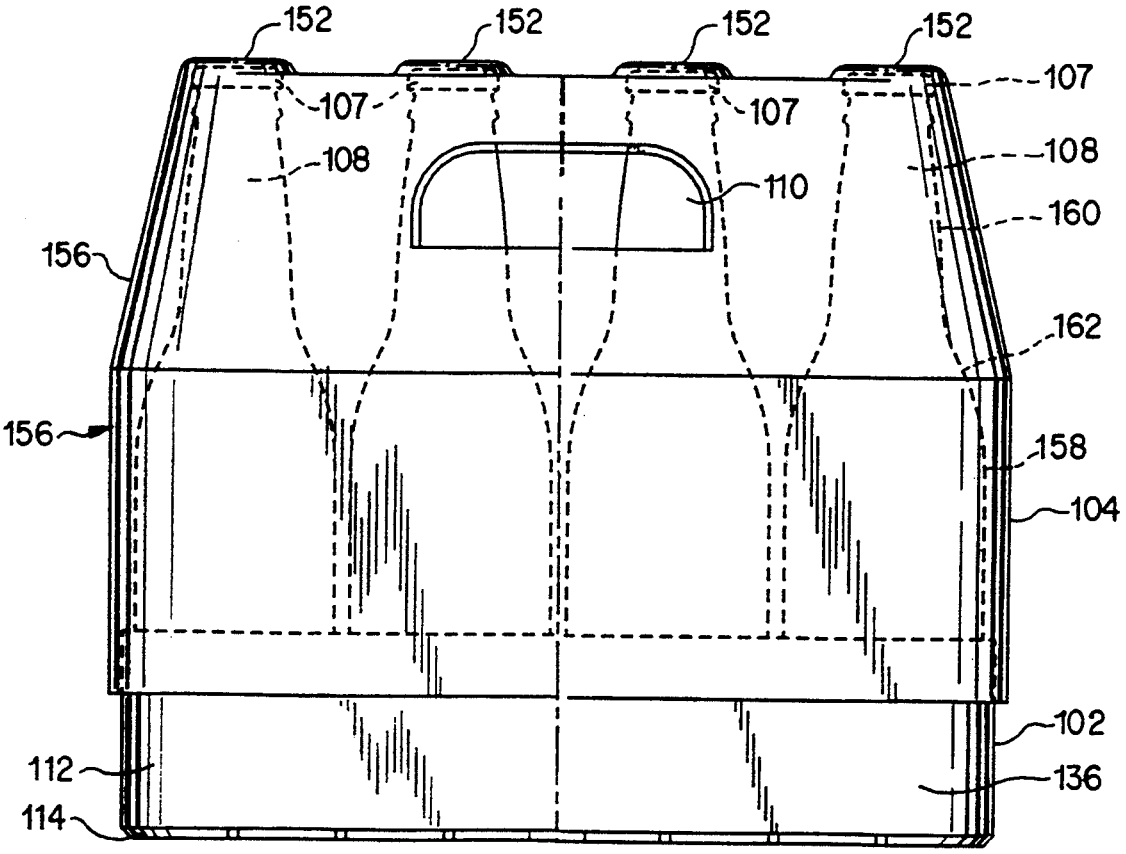
FIG. 2B is an end elevational view of the case of the present invention, as loaded in FIG. 1B.

As also shown in FIGS. 1B and 2B, an optional handle 110 may be provided in cover 104 for transporting the case 100. If such handle 110 is desired, however, a secondary strapping means or shrink-wrap 111 must be placed over the entire case 100 in order to hold cover 104 and tray 102 together. That is, since handle 110 is provided in cover 104, if one attempted to lift case 100 merely through the use of handles 110, cover 104 would be in the hands of the litter while tray 102 loaded with the bottles would not be lifted. Accordingly, a secondary means is necessary such that when a lifting force is applied to cover 104, tray 102, the bottles therein, and cover 104 are simultaneously lifted together as one unit.

Referring also to FIGS. 3–6, tray 102 is integrally molded from a plastic, such as a high density polyethylene, which is a standard container material, and in a sturdy, lightweight construction. Tray 102 comprises three basic components, namely, a rectangular wall structure 112, a floor 114 connected to the bottom of and disposed generally within wall structure 112, and a plurality of dividing walls 116 extending upwards from floor 114 and connecting opposing sides of wall structure 112 so as to form a plurality of individual bottle receiving compartments.

Figure 11:
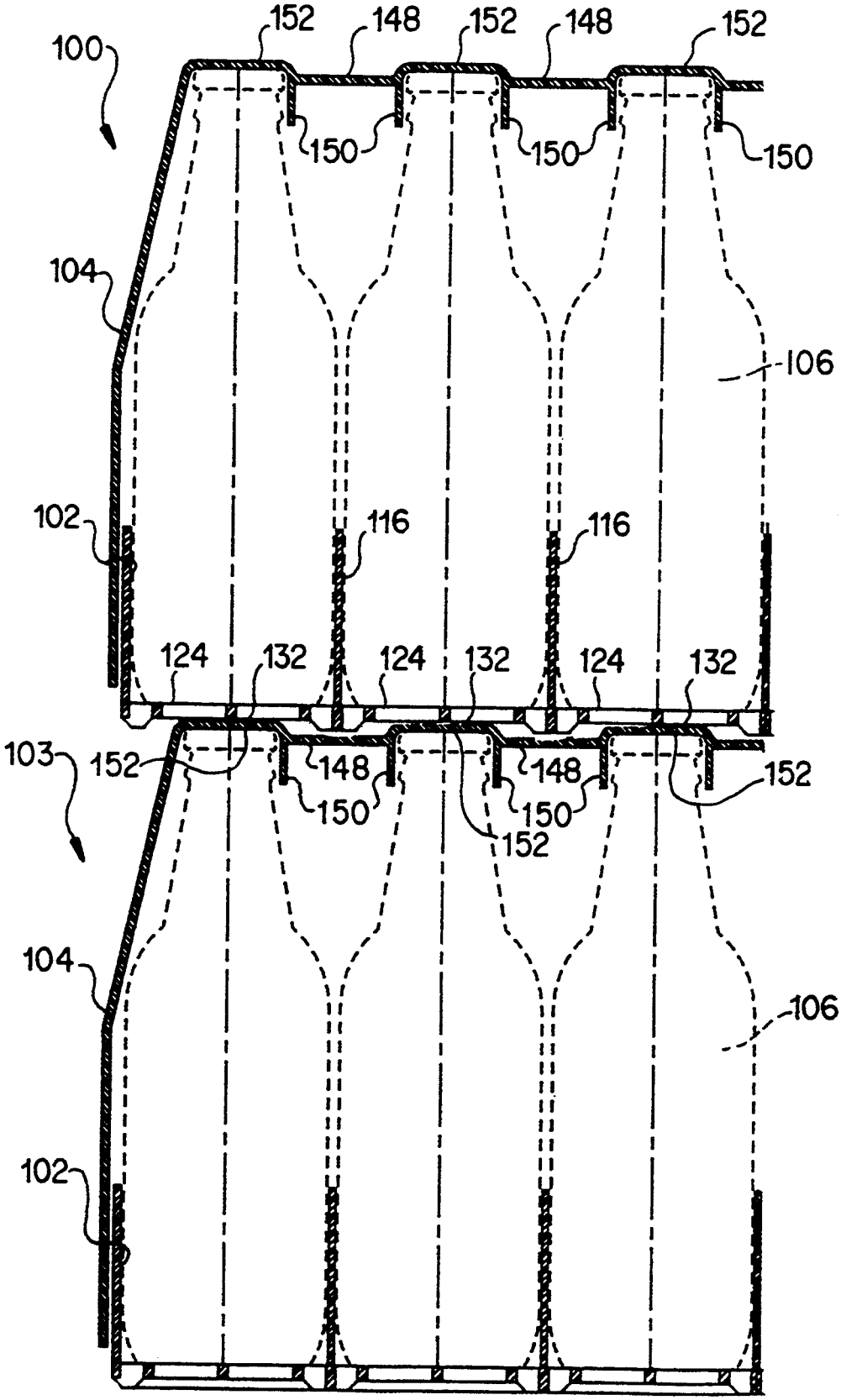
FIG. 11 is a side elevational view, with portions thereof broken away, of the loaded case of FIG. 1A in a stacked position.
Figure 12:
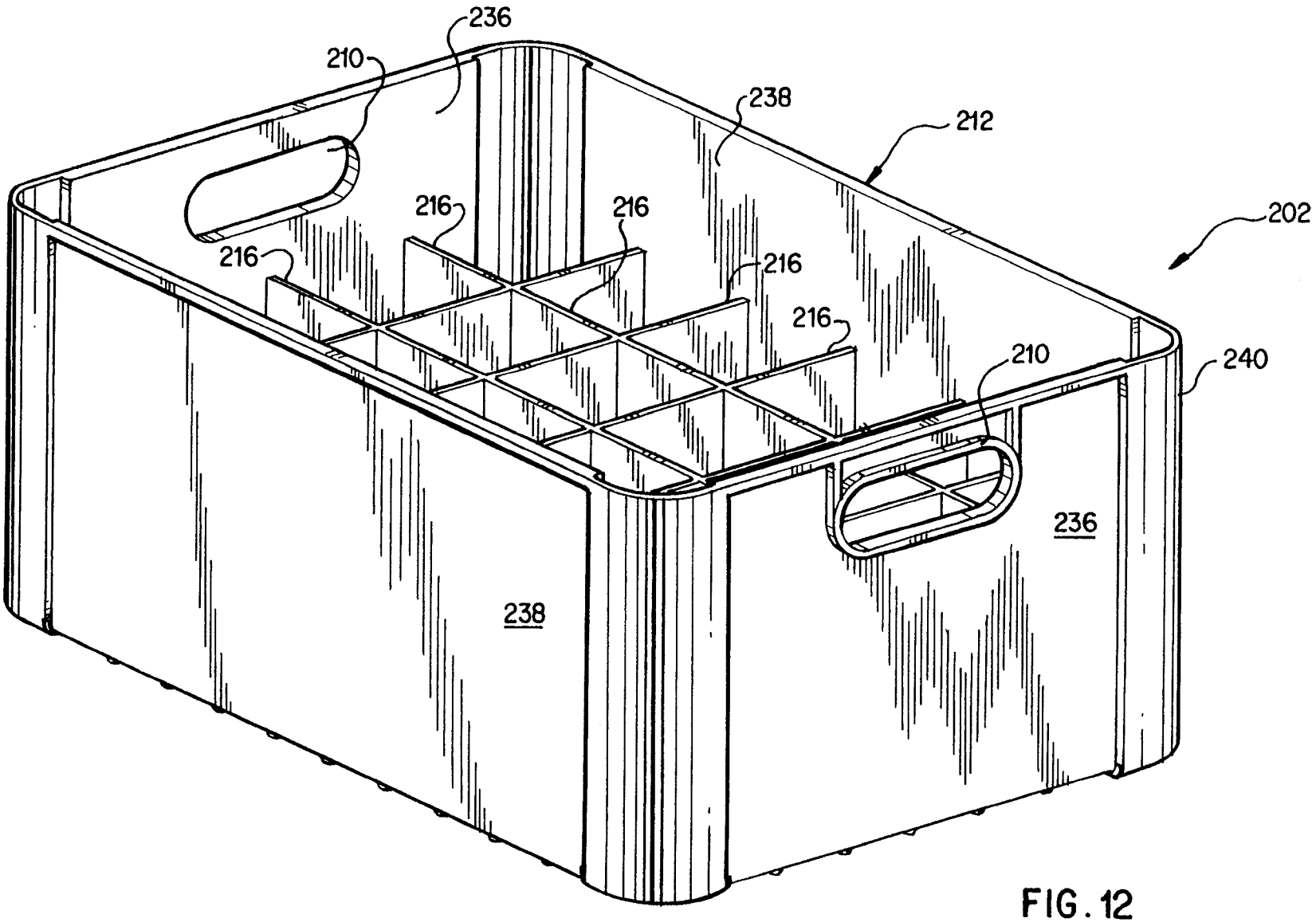
FIG. 12 is a top perspective view of the tray according to a second preferred embodiment of the present invention.
Figure 13A:
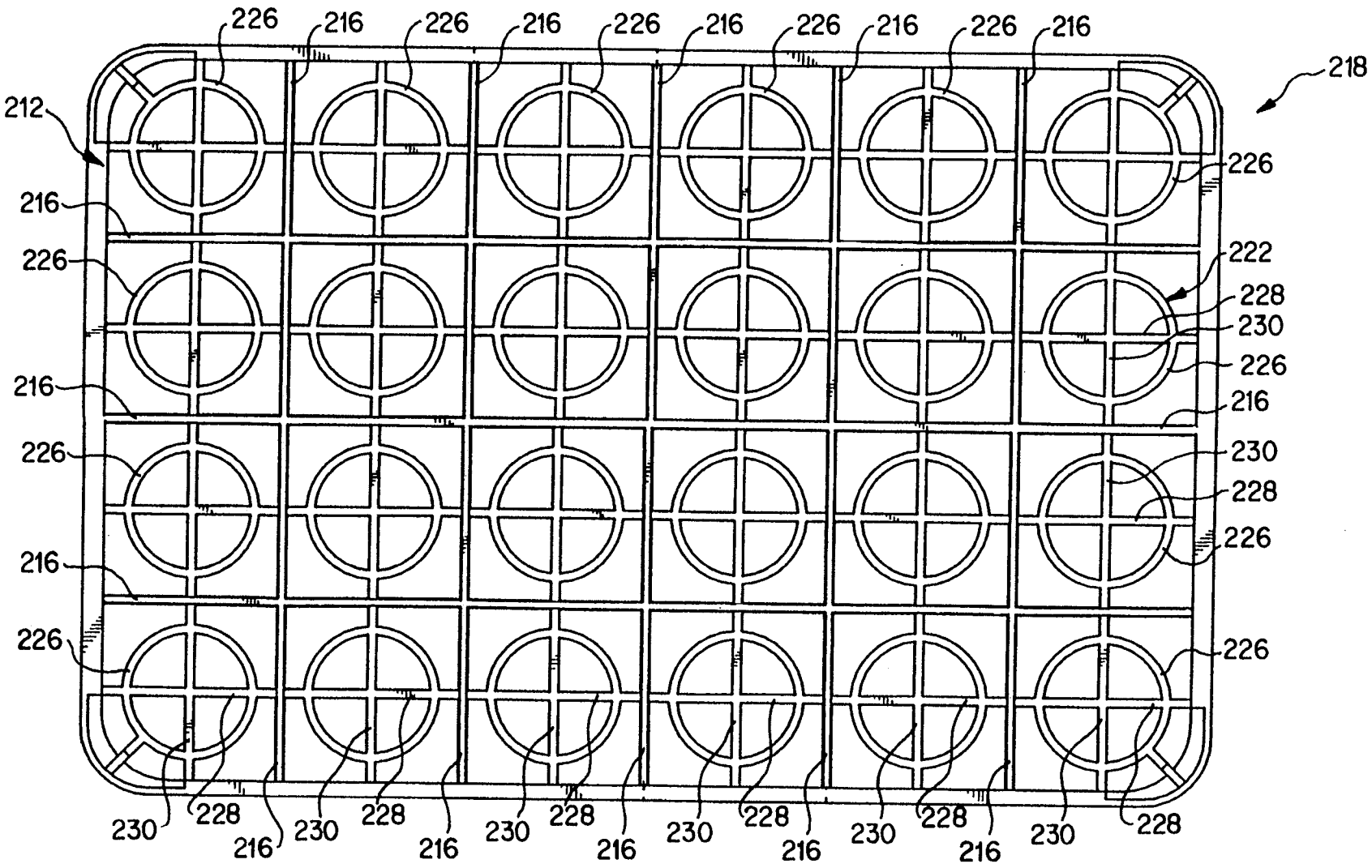
FIG. 13A is a top plan view of the tray shown in FIG. 12.
Figure 13B:
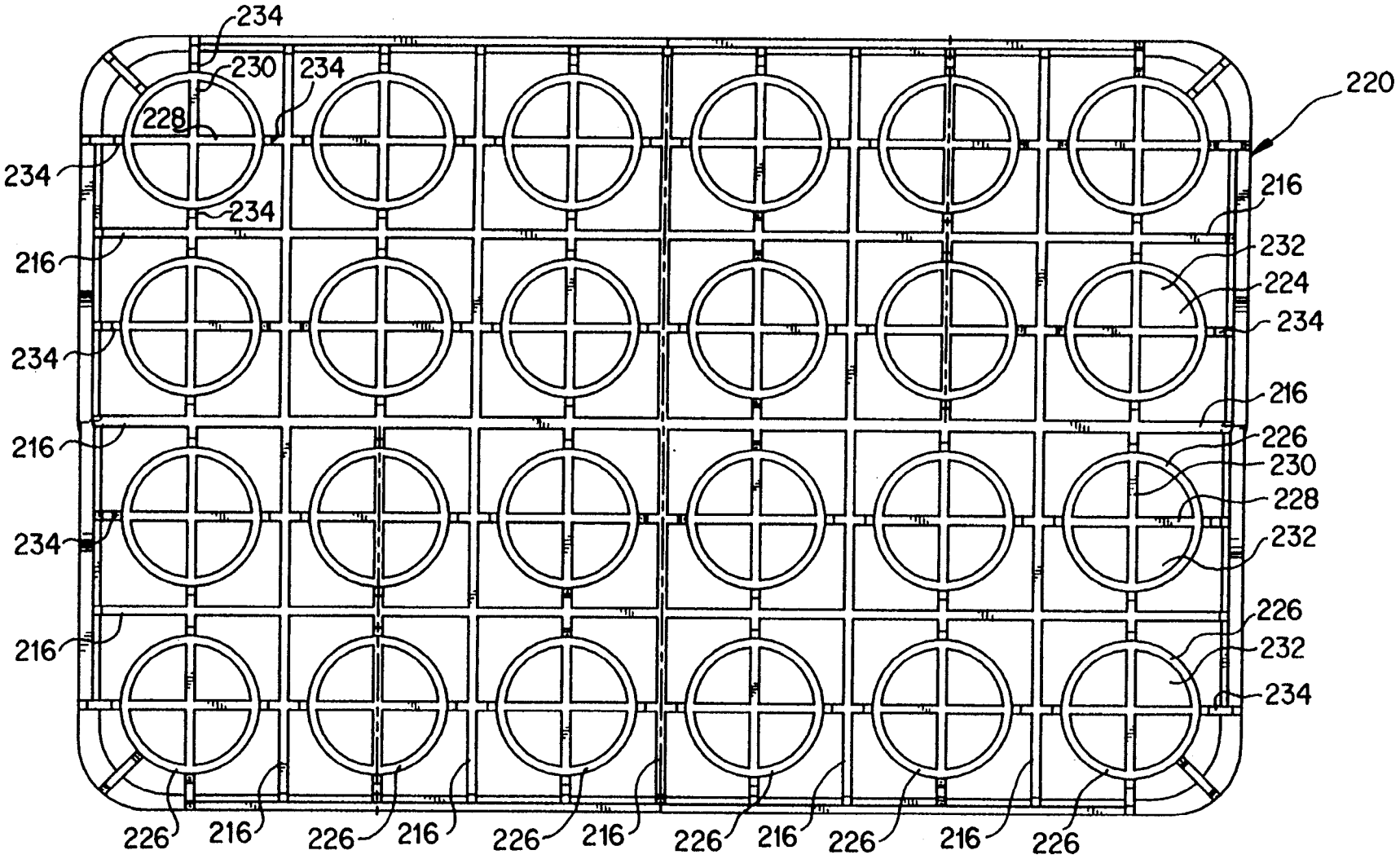
FIG. 13B is a bottom plan view of the tray shown in FIG. 12.
Figure 14:
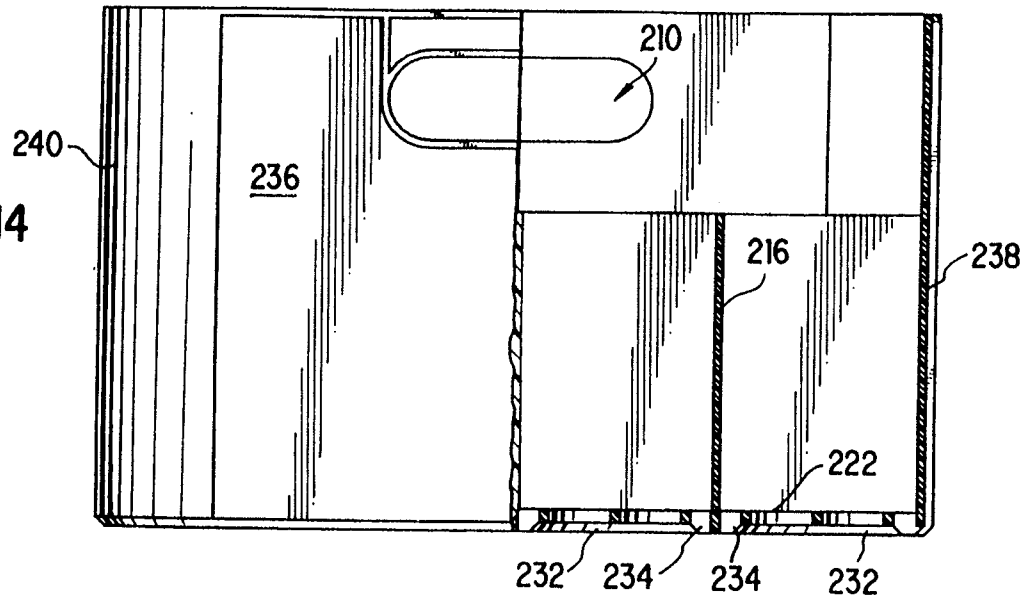
FIG. 14 is an end elevational view, with portions thereof broken away, of the tray shown in FIG. 12.
Figure 15:
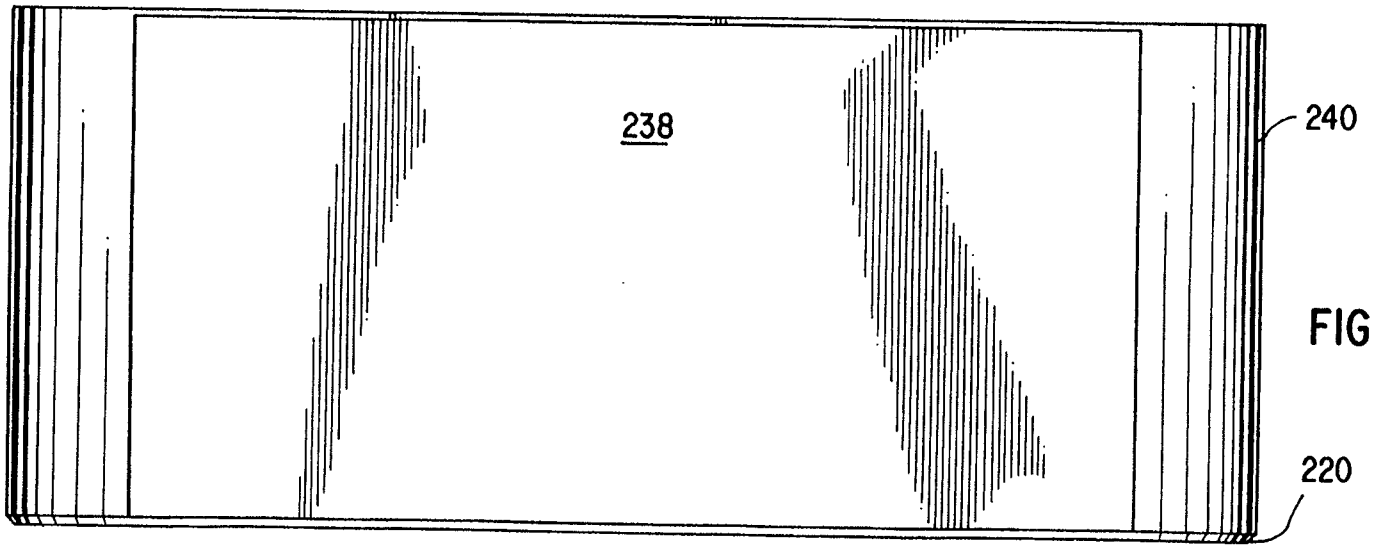
FIG. 15 is a side elevational view of the tray shown in FIG. 12.

Floor 114 has an upper surface 118 defining a plurality (twenty-four) of bottle support areas 122 for supporting thereon bottles 106 or 108. The floor bottom surface 120 has a plurality of receiving areas 124 for receiving therein the tops 107 of similar bottles 106 or 108 in a similar tray directly beneath the floor, as depicted in FIG. 11 by a similar (identical) loaded tray.

Figure 3A:
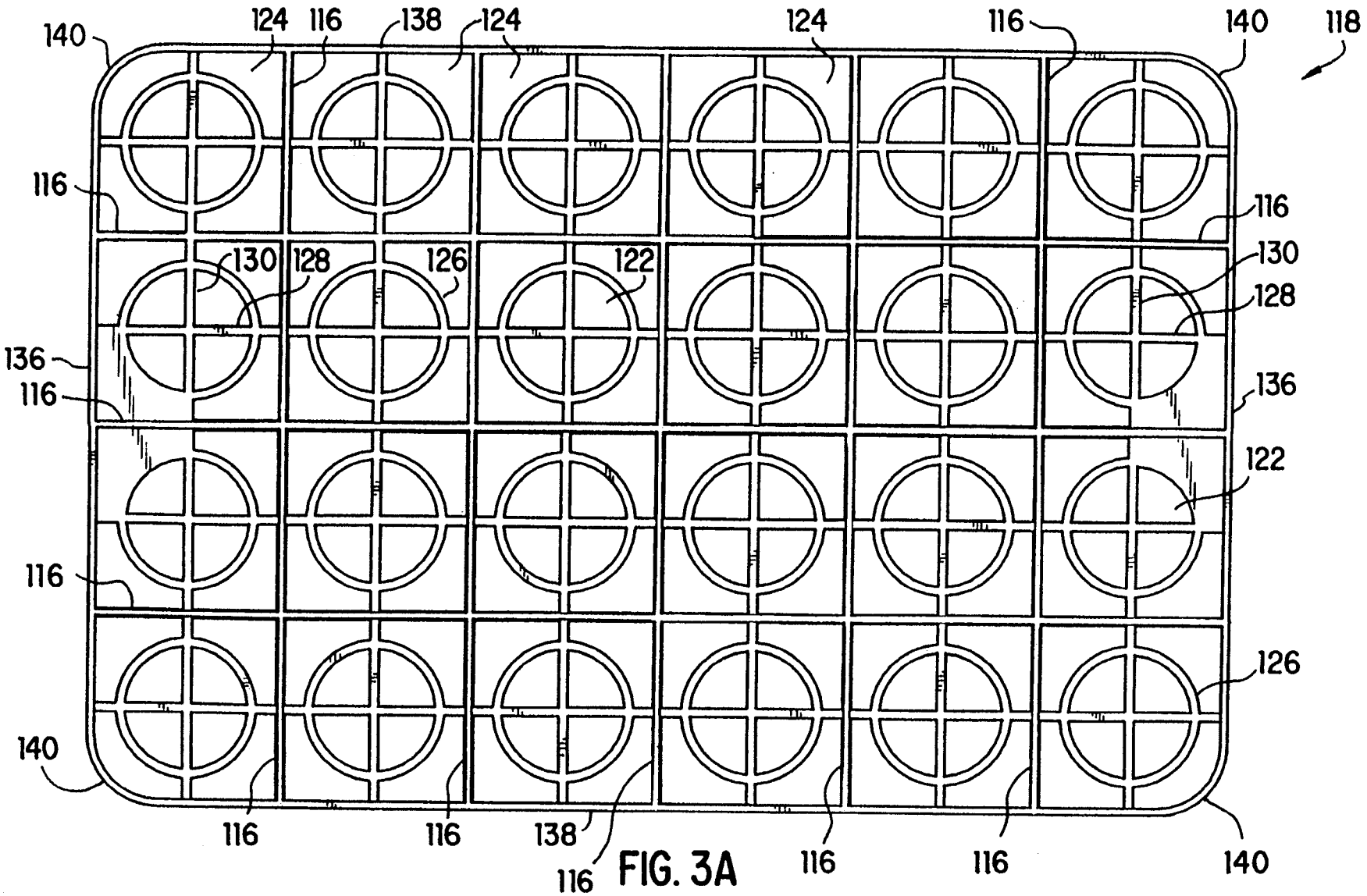
FIG. 3A is a top plan view of the tray of the present invention.
Figure 3B:
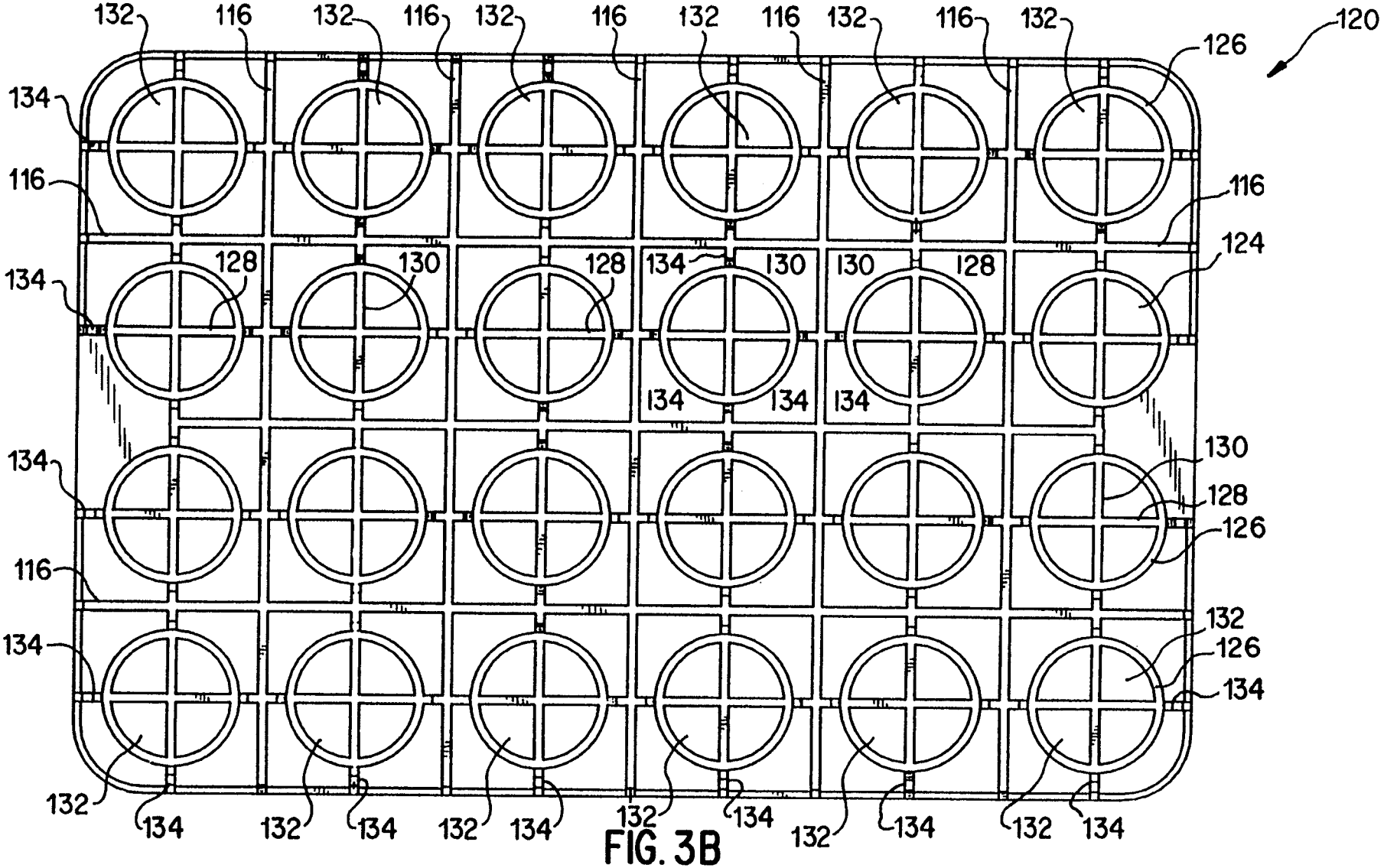
FIG. 3B is a bottom plan view of the tray of the present invention.
Figure 4:
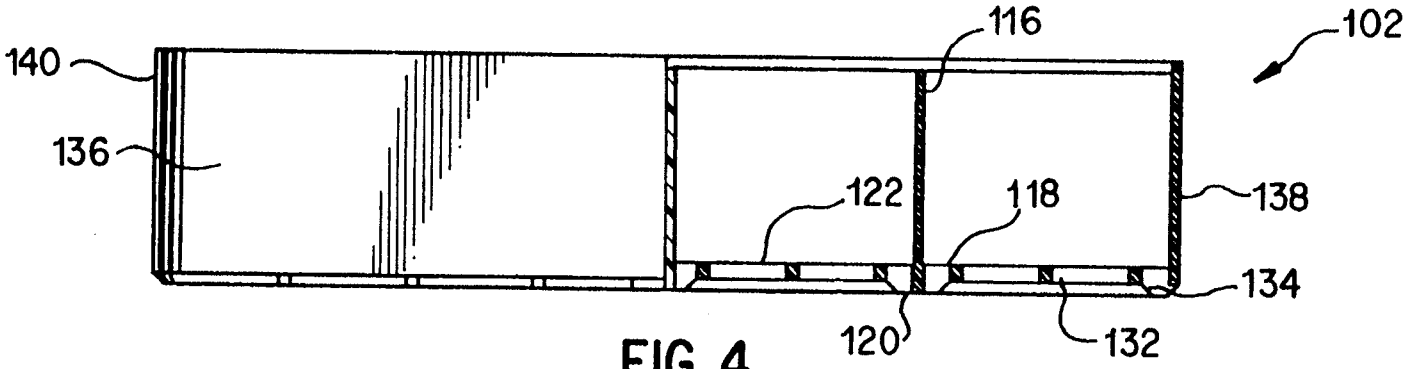
FIG. 4 is an end elevational view, with portions thereof broken away, of the tray shown in FIG. 3A.
Figure 5:
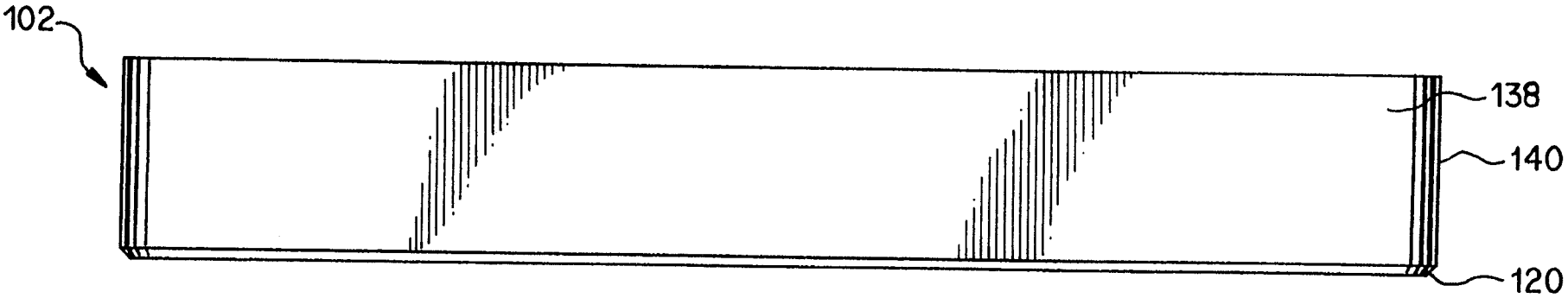
FIG. 5 is a side elevational view of the tray shown in FIG. 3A.
Figure 6:
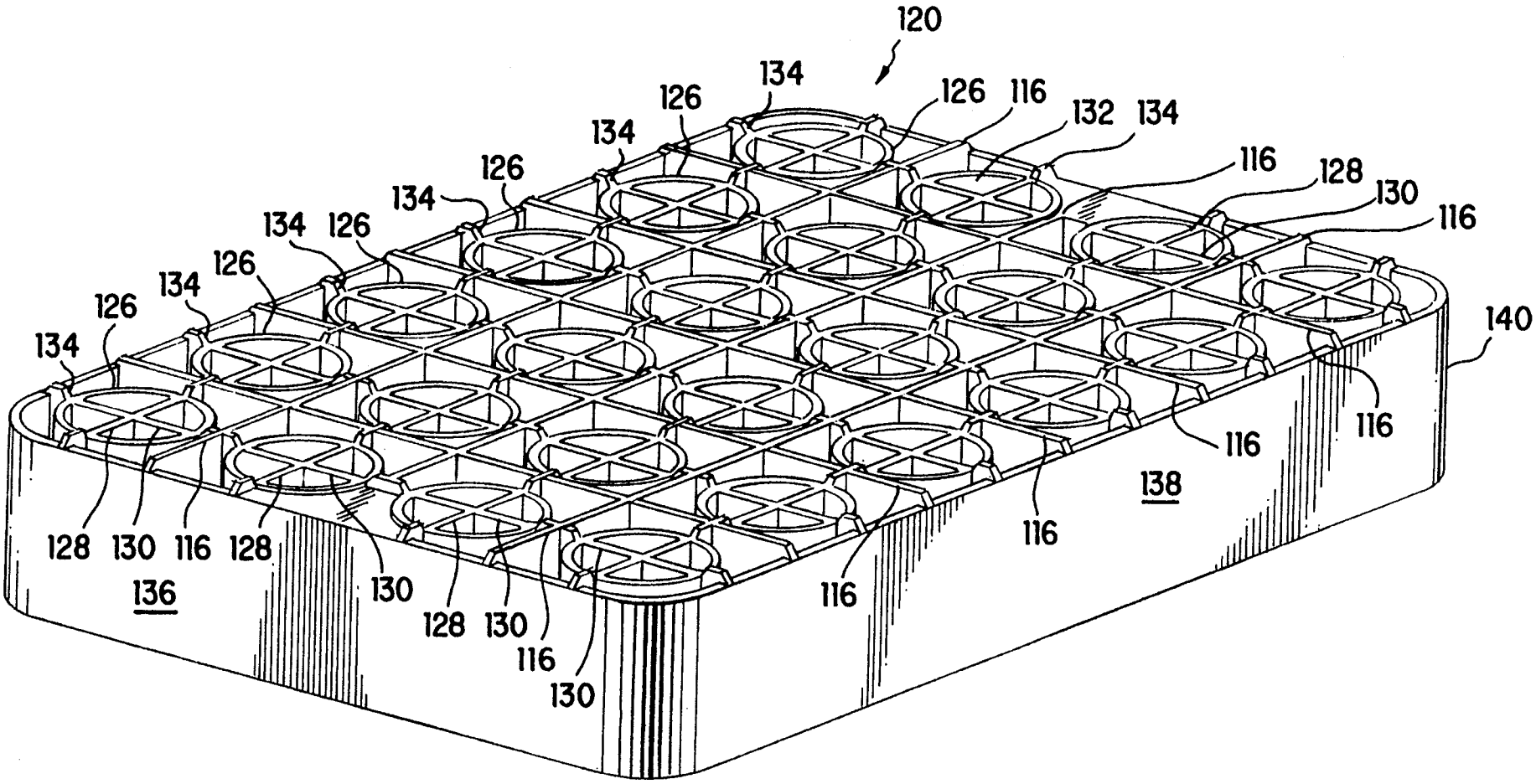
FIG. 6 is a bottom perspective view of the tray shown in FIG. 3A.
Figure 7:
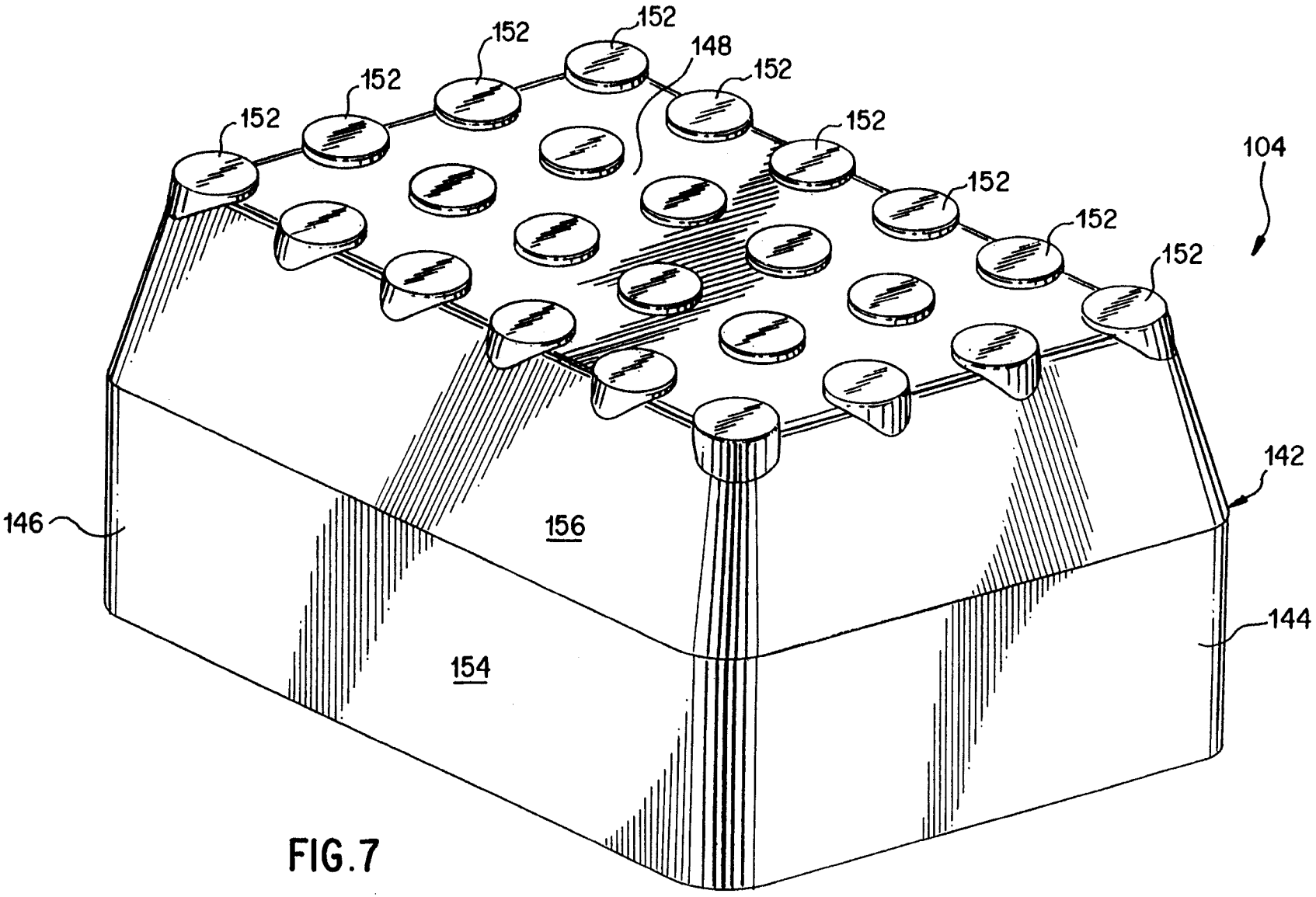
FIG. 7 is a top perspective view of the cover of the present invention as shown in FIG. 1A.
Figure 8:
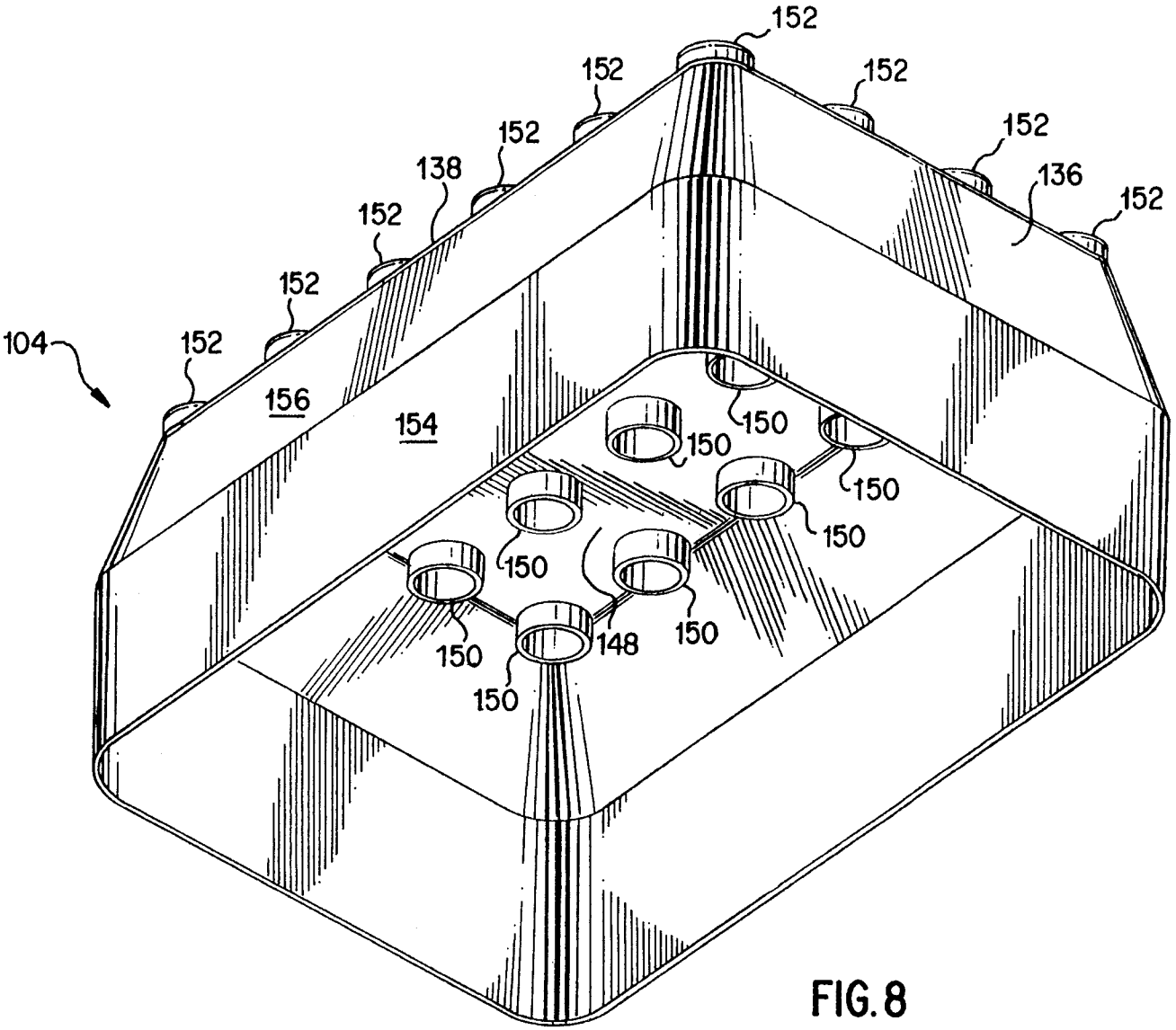
FIG. 8 is a bottom perspective view of the cover shown in FIG. 7.
Figure 9A:
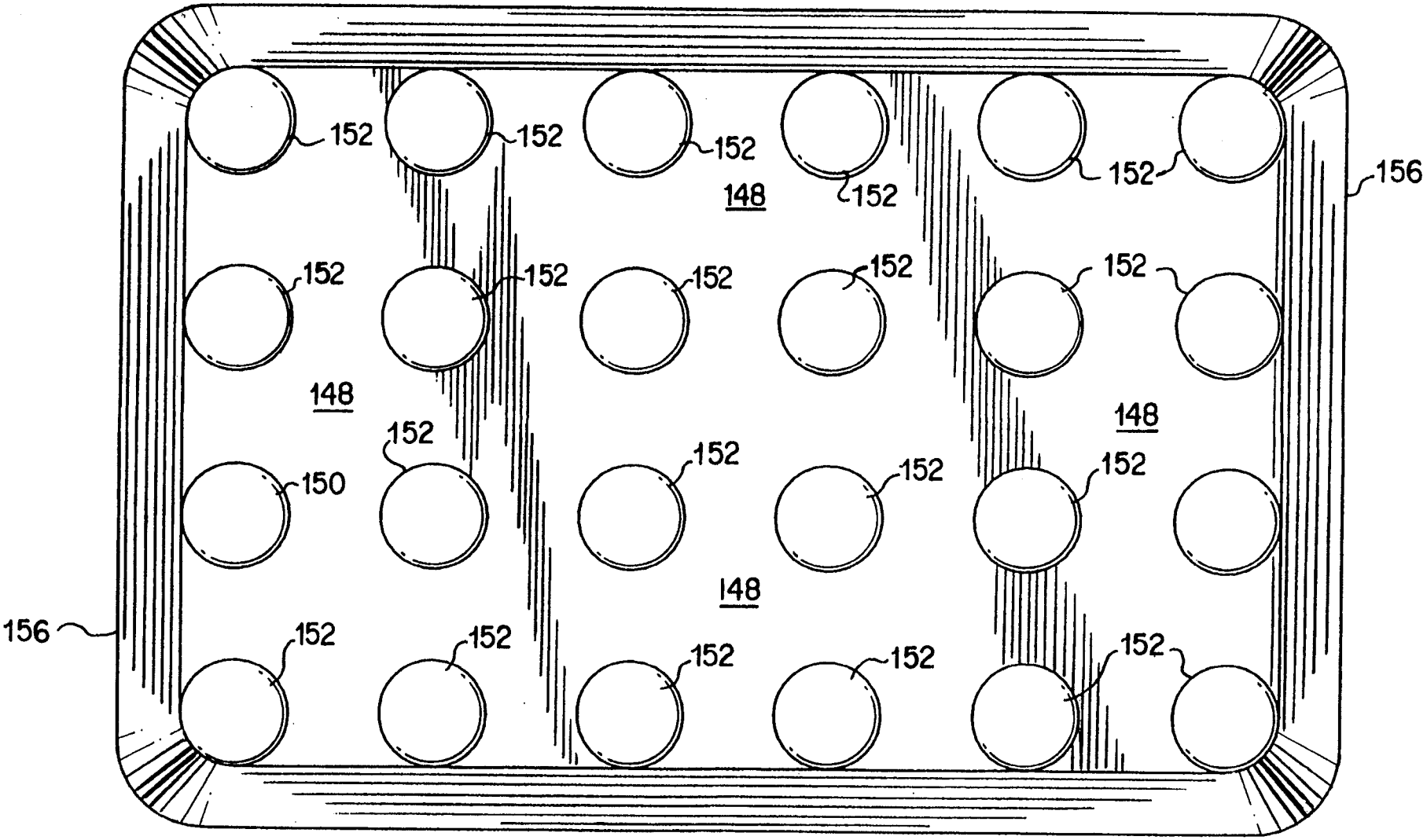
FIG. 9A is a top plan view of the cover shown in FIG. 7.
Figure 9B:
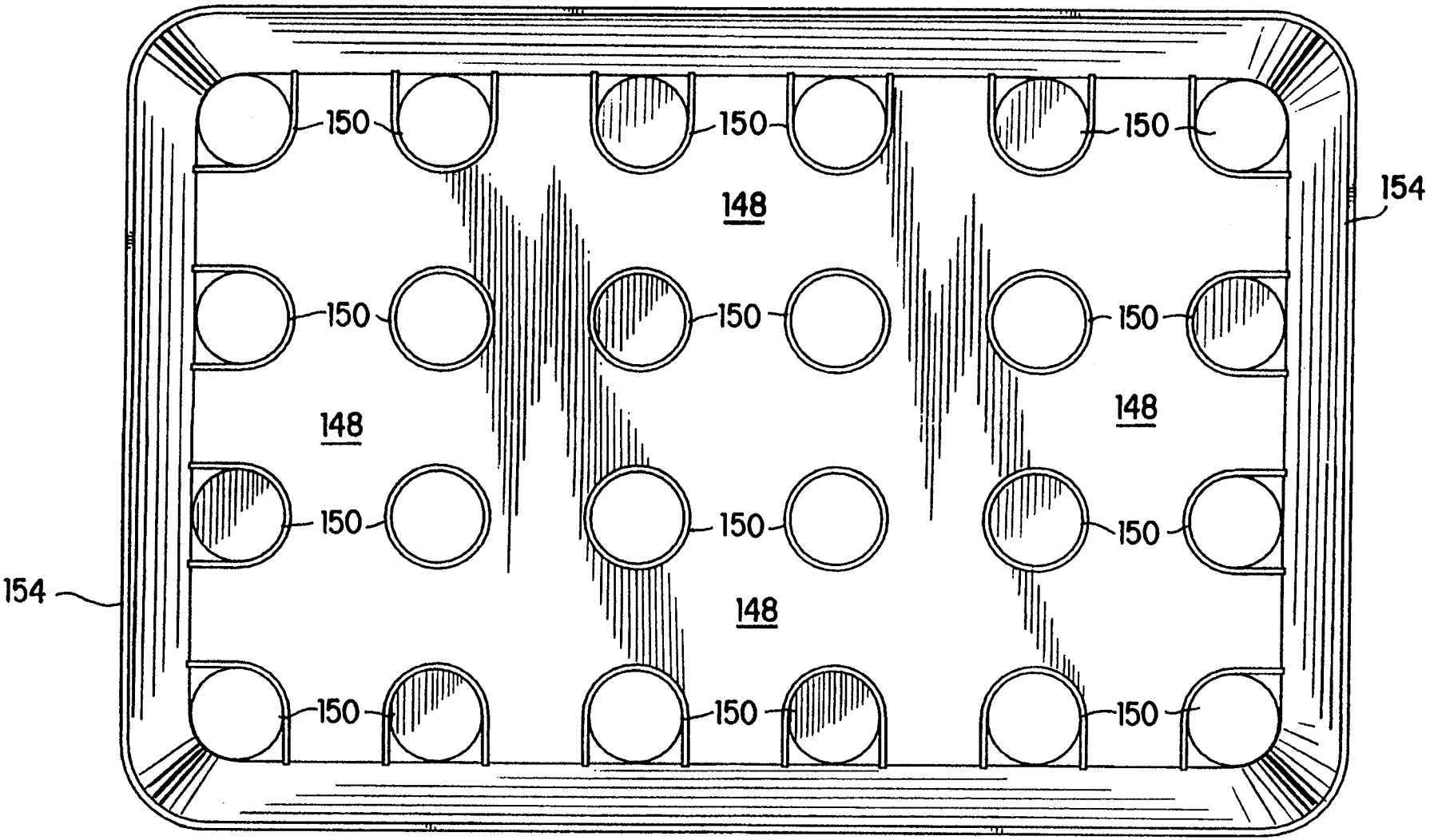
FIG. 9B is a bottom plan view of the cover shown in FIG. 8.
Figure 10:
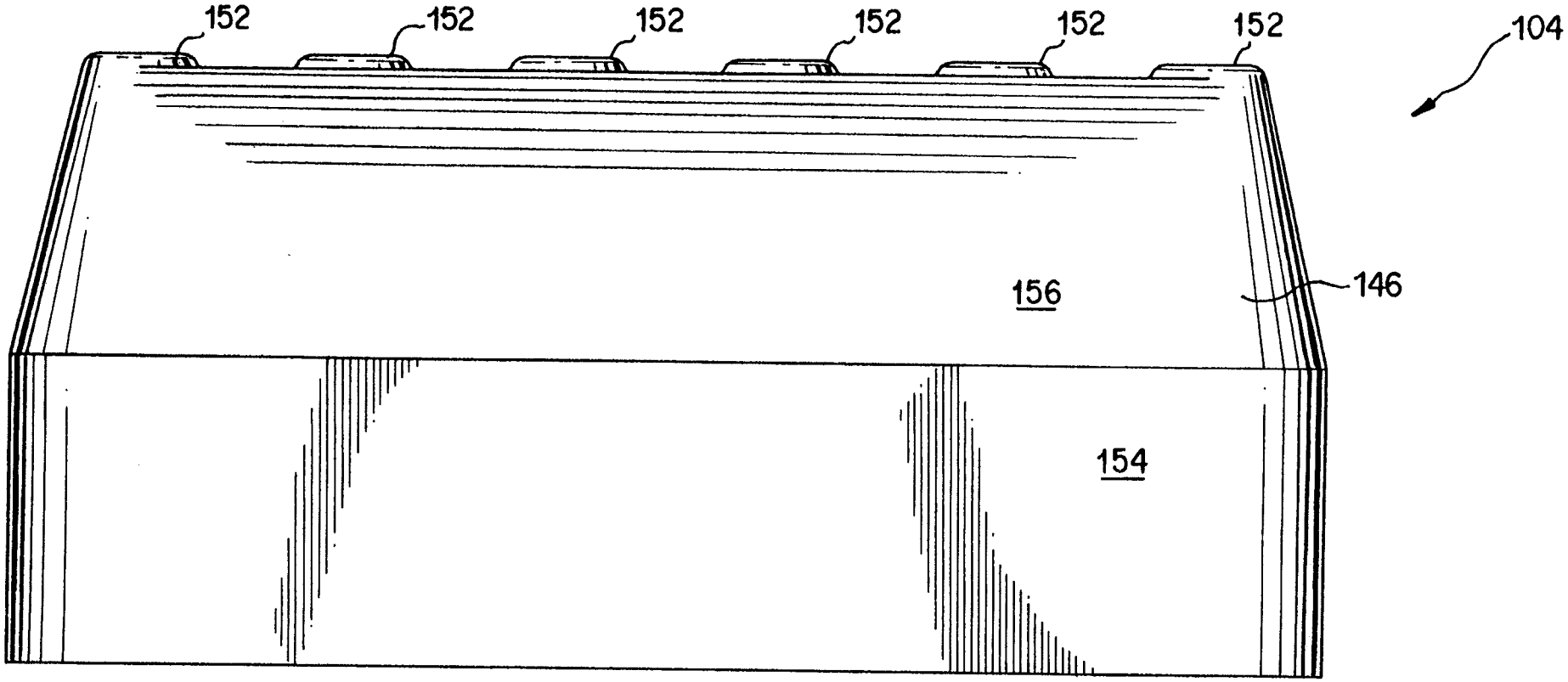
FIG. 10 is a side elevational view of the cover shown in FIG. 7.

A preferred design is to mold floor 114 with an open gridwork configuration having a pattern of open spaces therethrough, as shown in FIGS. 3 and 6, so that less plastic floor material is needed. Floor 114 is thereby made cheaper and lighter, and an attractive design is thereby presented. Any liquids, such as wash water, condensation, rain water or leaking beverages from damaged bottles, are also able to drain therethrough due to the open gridwork construction. Floor upper surface 118 preferably comprises a plurality of circular members 126, one for each bottle support area 122. A plurality of longitudinal struts 128 and lateral struts 130 extend out from each of circular members 126 in order to connect and support them to dividing walls 116 and/or wall structure 112. As illustrated, longitudinal struts 128 and lateral struts 130 also extend through the interior of circular members 126 thereby forming a strong support structure for bottles 106 and 108. Circular members 126 thus make it relatively easy to count the number of support areas 122 in an empty tray 102 and also to position the beverage bottles 106 or 108 on the floor 114.

The floor bottom surface 120 is recessed upwardly at each receiving area 124 for receiving thereinto the tops of bottles 106 or 108 from a layer of bottles disposed in a similar case 103 beneath the floor 114, in a preferred design of this invention. As best shown in FIG. 6, the bottom surface of circular members 126 defines a first generally planar surface and the bottom surface of dividing walls 116 defines a second generally planar surface which extends below the bottom surface of the circular members 126 to thereby form a generally circular recess 132. Each recess 132 is further defined by having the bottom surfaces of longitudinal struts 128 and lateral struts 130 angling downwards from the outer perimeter of circular member 126 to the dividing wall 116 or wall structure 112 to which it is connected. This angled surface of longitudinal and lateral struts 128 and 130 forms a bevelled edge 134 for each recess 132. Thus, a portion of the bottom surfaces of longitudinal lateral struts 128 and 130 coincide with the first plane of the bottom surface of circular member 126, while a portion of longitudinal and lateral struts 128 and 130 connecting circular members 126 to the dividing walls and wall structure lie in the second plane corresponding to that of the bottom surface dividing walls 116. Any similar construction for holding the floor bottom surface 120 to the tops of a bottom container layer therebeneath, as would be apparent to those skilled in the art, to prevent free sliding is within the scope of this invention.

Wall structure 112 comprises opposing end walls 136 and opposing side walls 138. End walls 136 have curved end portions 140 which join with side walls 138 to thereby form a low-depth rectangular structure. The height of side and end walls 138 and 136 is approximately the same or slightly greater than that of dividing walls 116.

Referring now to FIGS. 7–10, it is seen that cover 104 comprises a wall structure 142 formed from connecting opposing end walls 144 and opposing side walls 146 and a ceiling 148 connected to the top surface of wall structure 142.

Ceiling 148 includes a generally planar surface defining an upper surface of cover 104. Ceiling 148 includes a plurality of separator rings 150 projecting downwards from the planar surface of the ceiling and a plurality of receiving caps 152 projecting upwards from the planar surface of the ceiling. Separator rings 150 and receiving caps 152 are integrally joined so as to form openings in the planar surface of ceiling 148. As shown, separator rings 150 receive therethrough the rims of bottles 106 or 108 such that the bottle tops 107 project above the upper surface of ceiling 148 and are thereby received within receiving caps 152 such that further movement of tops 107 above ceiling 148 is thereby halted. In combination with dividing walls 116 of tray 102, separator rings 150 and receiving caps 152 maintain bottles 106 or 108 in an upright and spaced position so as to prevent adjacent bottles 106 or 108 from contacting one another.

Wall structure 142 of cover 104 further includes a lower wall portion 154 and an upper wall portion 156. Lower wall portion 154 is generally vertically aligned so as to fit about the external periphery of tray 102. However, in the preferred embodiment, upper wall portion 156 is canted inwards so as to conform more closely with the tapering necks of bottles 106 and 108. As a result, the uppermost surface of case 100 is smaller than that of the lowermost surface. As illustrated in FIG. 11, this provides an ideal stacking arrangement. That is, receiving caps 152 of a lower case 103 are situated directly beneath receiving areas 124 of an upper case 100 when a plurality of similar cases are stacked for transporting or storing. When the cases are stacked in this manner, a completely closed environment is obtained, thus preventing external light, sunshine, or the like from reaching the contents of bottles 106 or 108. In turn, the deterioration of the contents, such as an alcoholic beverage for example, due to an external light source, is eliminated.

Figure 18A:
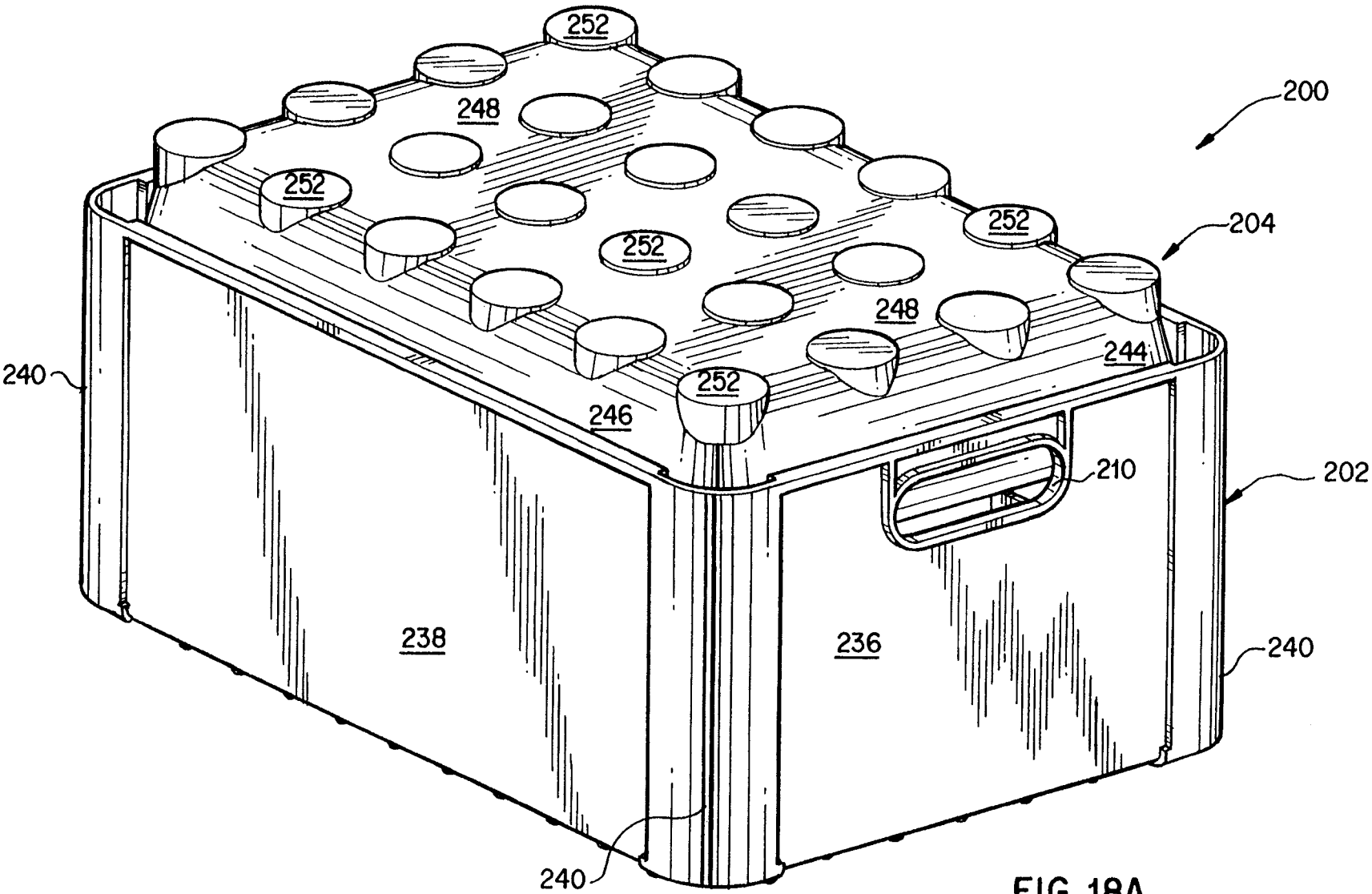
FIG. 18A is a perspective view of the tray and cover according to the second embodiment when loaded with bottles having a first diameter and height.
Figure 18B:
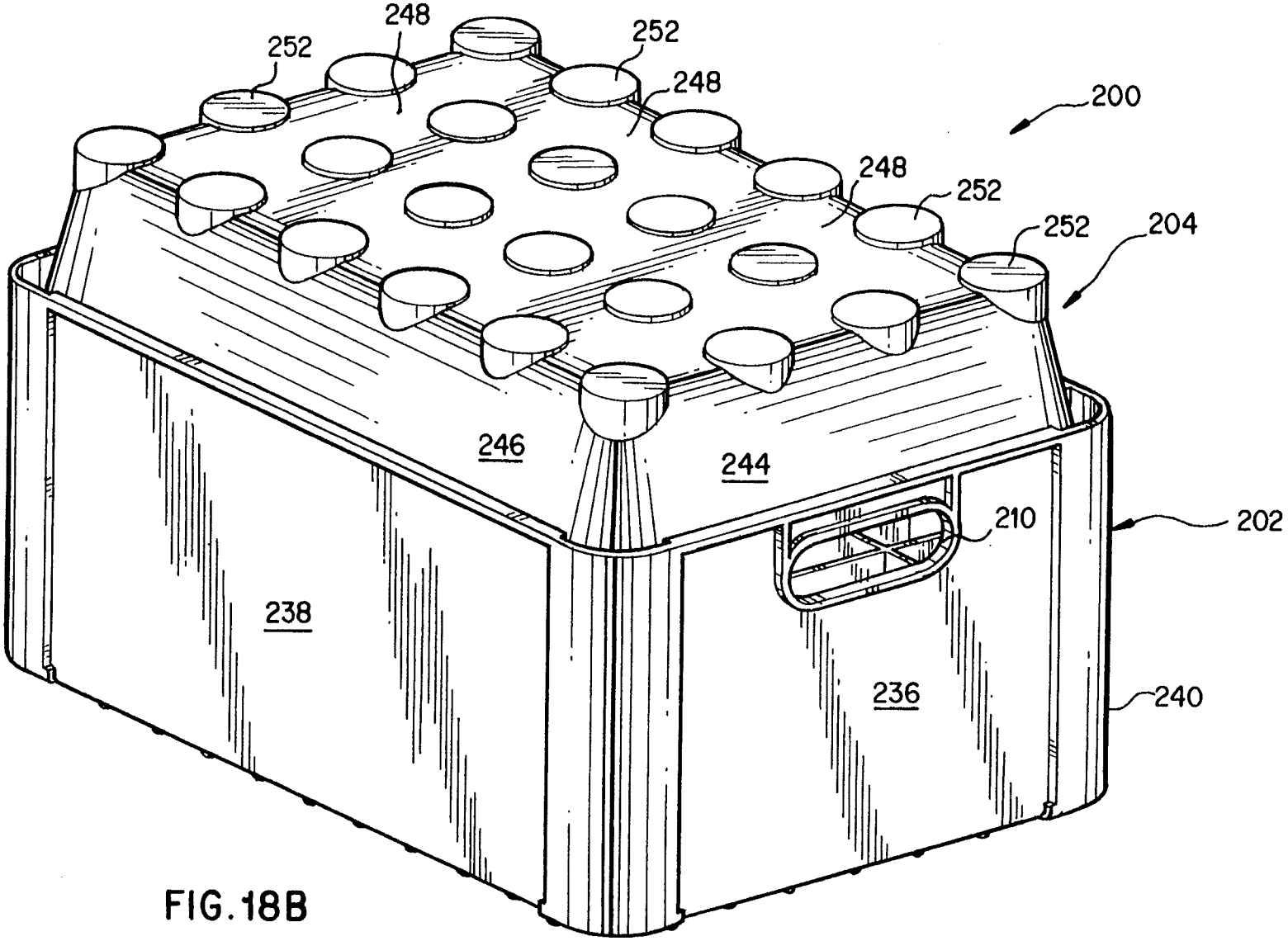
FIG. 18B is a perspective view of a tray and cover according to the second embodiment when loaded with bottles having a second diameter and height.
Figure 19A:
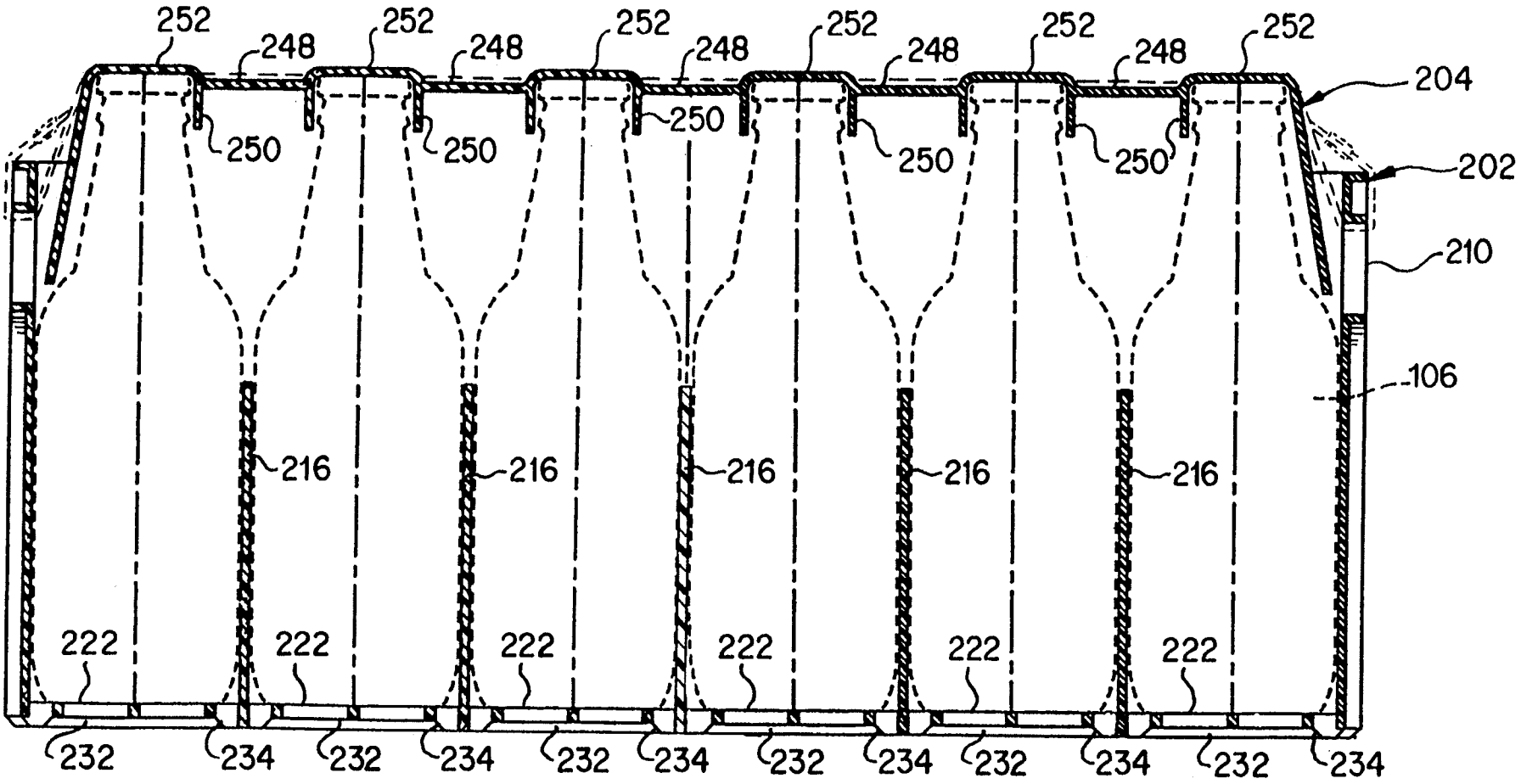
FIG. 19A is a cross-sectional view of the tray and cover according to the second embodiment when loaded with bottles of a first diameter and height.
Figure 19B:
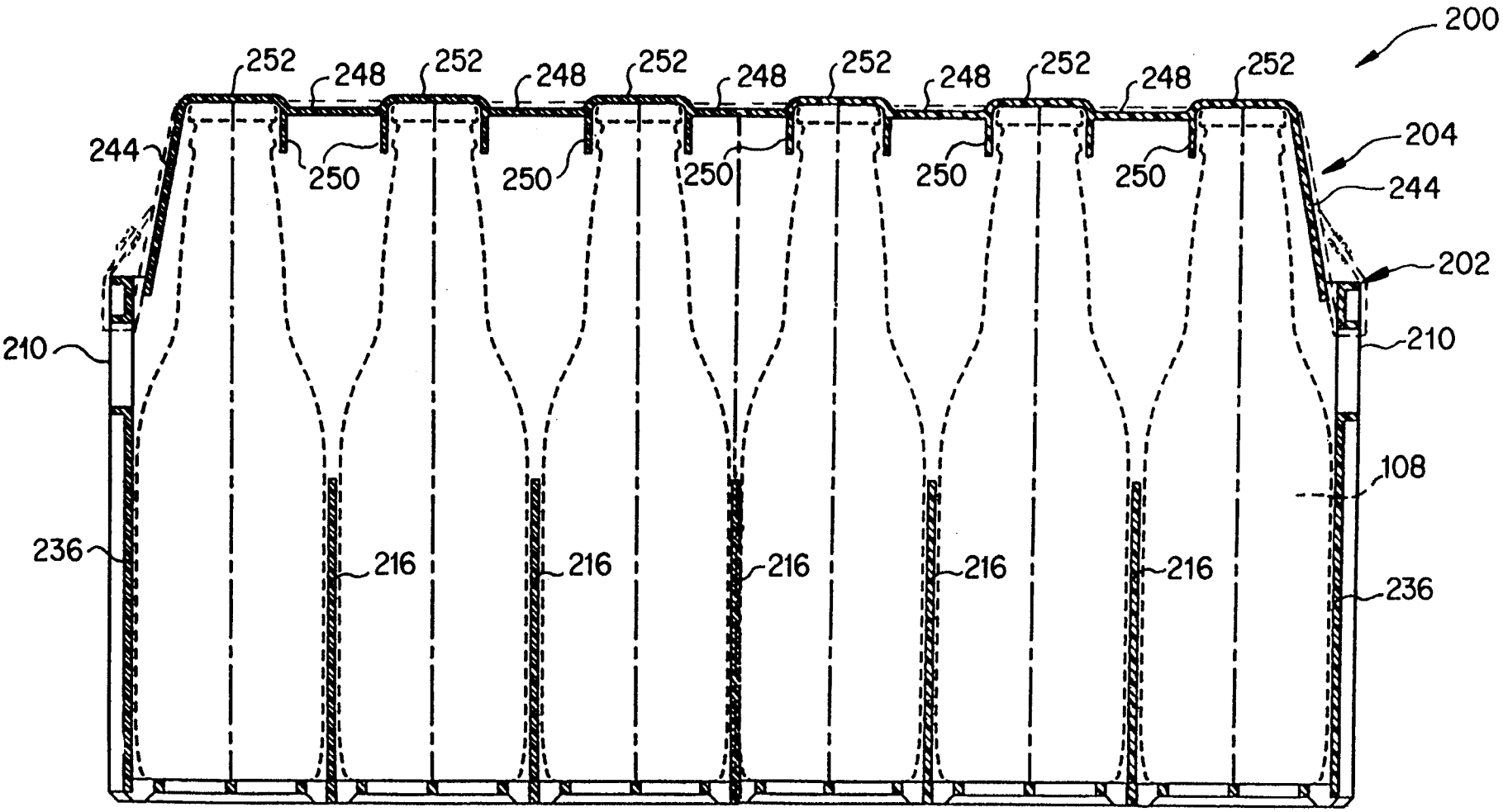
FIG. 19B is a cross-sectional view of the tray and cover according to the second embodiment when loaded with bottles of a second height and diameter.
Figure 20A:
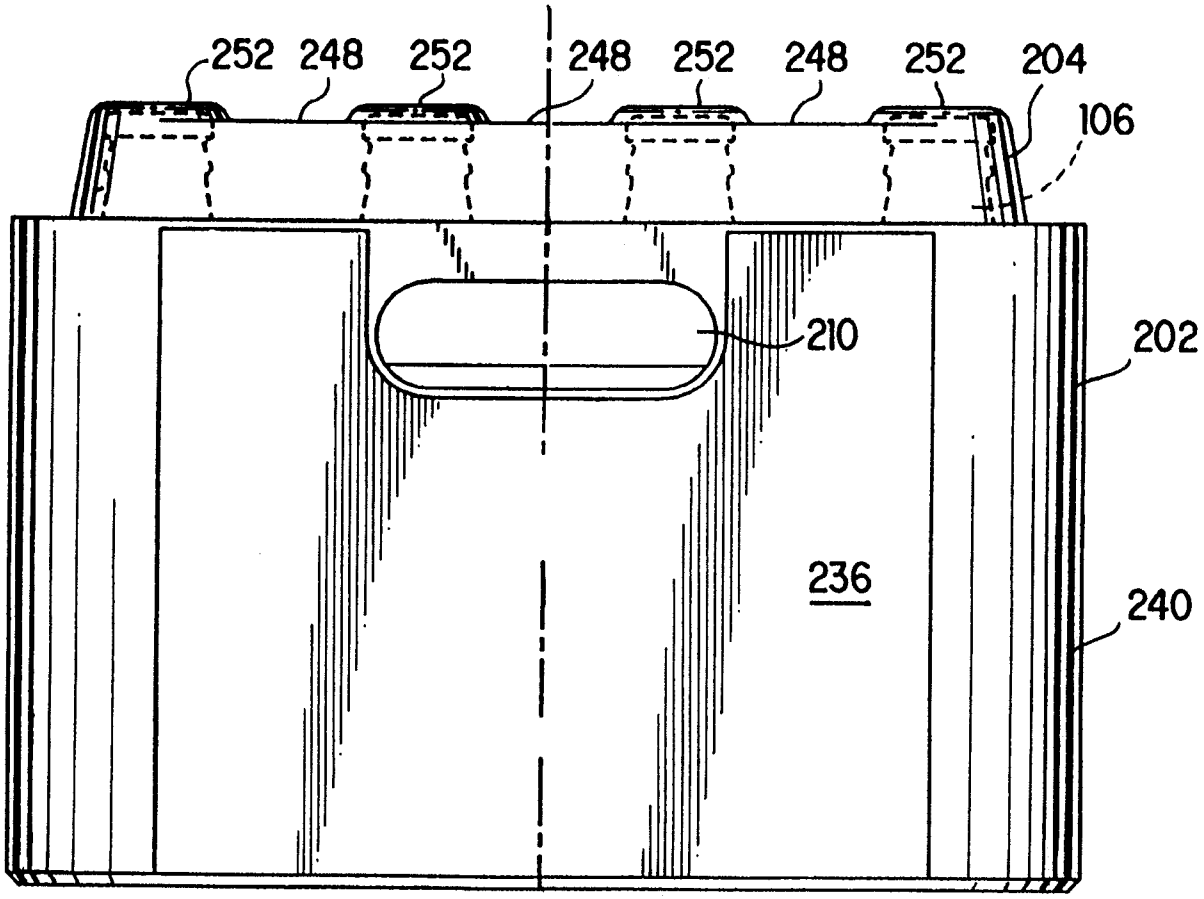
FIG. 20A is an end elevational view of the tray and cover when loaded as shown in FIG. 19A.
Figure 20B:
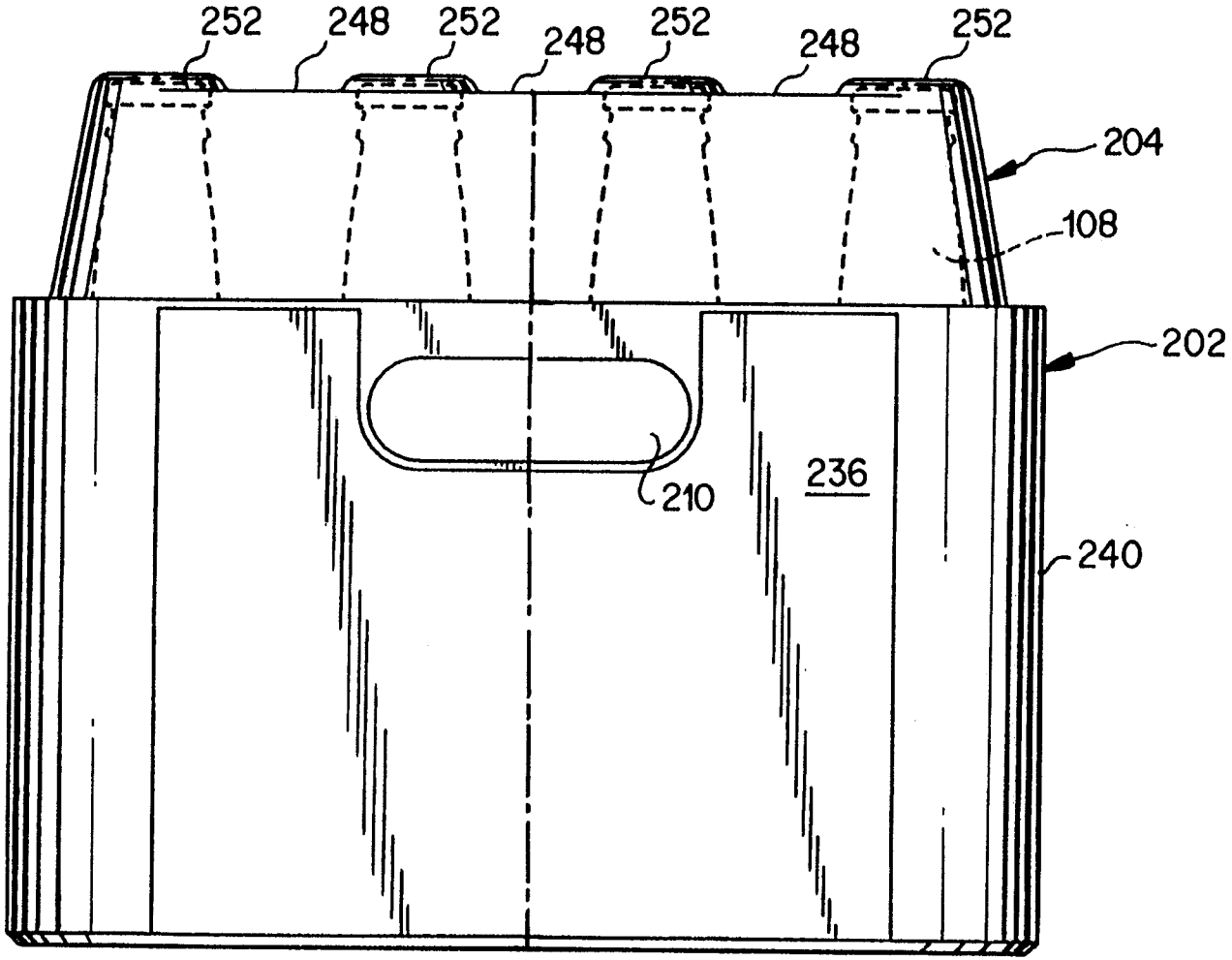
FIG. 20B is an end elevational view of the tray and cover when loaded as shown in FIG. 19B.

An alternative design of the present invention uses a full-depth wall structure and an internally disposed cover rather than the low-depth wall structure and external cover of case 100. A full-depth wall structure is illustrated by the case shown generally at 200 in FIGS. 18 and 19, for example, wherein the wall structure of tray 202 extends substantially the full height of bottles 106 or 108 and cover 204 is disposed inside of the outer periphery of tray 202. Similar to the first embodiment and as illustrated by FIGS. 18A and 19A, when shorter bottles 106 are loaded in tray 202, cover 204 rests deeper within tray 202 than when taller bottles 108 are loaded, as shown in FIGS. 18B and **19*b*. In both instances, however, cover 204 and tray 202 form a sufficiently enclosed case 200 such that the contents of bottles 106 or 108** will not be subject to deterioration from exposure to external light or sunlight.

Referring also to FIGS. 12–16, it is seen that tray 202 is similarly comprised of three components, that is, a wall structure 212, a floor 214 and a plurality of dividing walls 216 extending transversely and laterally across tray 202 such that a plurality of individual bottle receiving compartments are thereby formed. Wall structure 212 is formed by opposed end walls 236 and opposed side walls 238 joined together by curved end portions 240 to thereby form a generally rectangular structure. Handles 210, formed as through-openings in end walls 236, may also be provided to provide a readily accessible means for transporting and handling case 200. In contrast to the first embodiment of case 100, no secondary packaging on overwrap is required for handles 210 to be utilized, since the handles are provided in the tray itself rather than in the cover.

Similar to tray 102, the upper surface 218 of floor 214 comprises a plurality of support areas 222 for supporting thereon bottles 106 or 108. Support areas 222 are formed by circular members 226 as well as longitudinal struts 228 and lateral struts 230 which connect and support circular members 226 within the surrounding structure. Longitudinal and lateral struts 228 and 230 may also extend through circular members 226 to thereby provide a sturdy support surface for bottles 106 or 108 to define a smooth planar surface. Circular members 226 are arranged in an array such that each circular member is generally centered within a bottle receiving compartment formed by dividing walls 216. In the preferred embodiment shown, there are twenty-four bottle receiving compartments formed by dividing walls 216 and a circular member 226 is generally centered within each of the compartments. Also similar to tray 102, bottom surface 220 of floor 214 comprises a plurality of receiving areas 224 for receiving therein bottle tops 107 of a lower layer of bottles 106 or 108 loaded in a similar case therebeneath. Receiving areas 224 are defined by a recess 232 generally centered within each bottle receiving compartment formed by dividing walls 216 on upper surface 218. Also similar to tray 102, the bottom surfaces of dividing walls 216 form a lowermost planar surface and the bottom surfaces of circular members 226 define a planar surface spaced above that of dividing walls 216. Longitudinal and lateral struts 228 and 230 are provided with beveled edges 234 interconnecting the portions of struts 228 and 230 disposed in the planar surface of dividing walls 216 and the portion of struts 228 and 230 disposed in the plane of circular members 226. Thus, recesses 232 are formed generally below each circular member 226 and have a beveled perimeter formed by beveled edges 234 of struts 228 and 230.

Figure 16A:
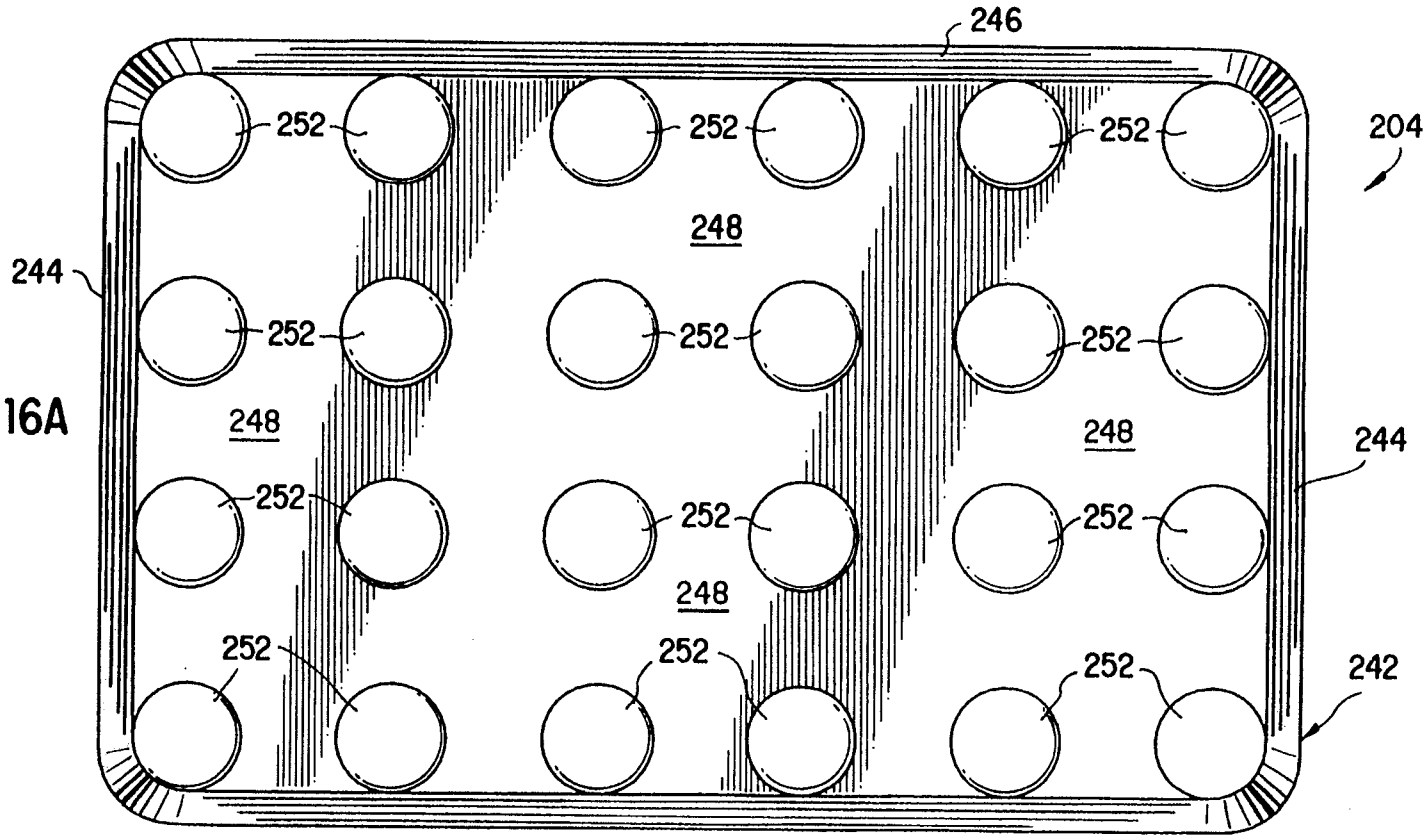
FIG. 16A is a top plan view of a cover according to a second embodiment of the present invention.
Figure 17:
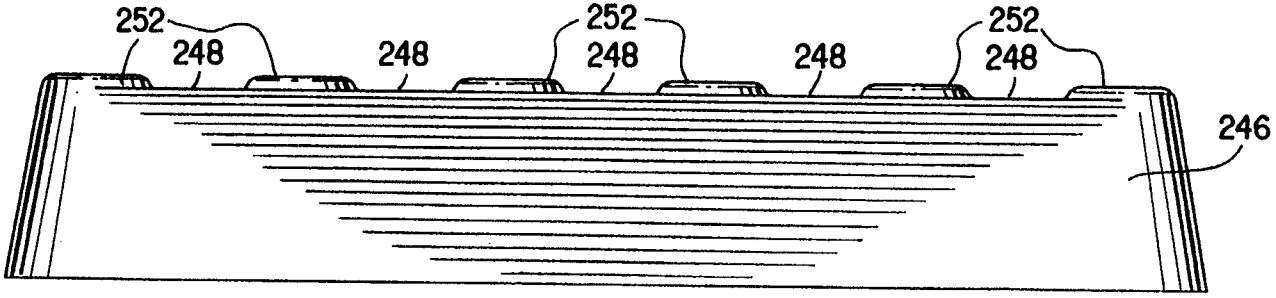
FIG. 17 is a side elevational view of the cover shown in FIG. 16A.
Figure 16B:
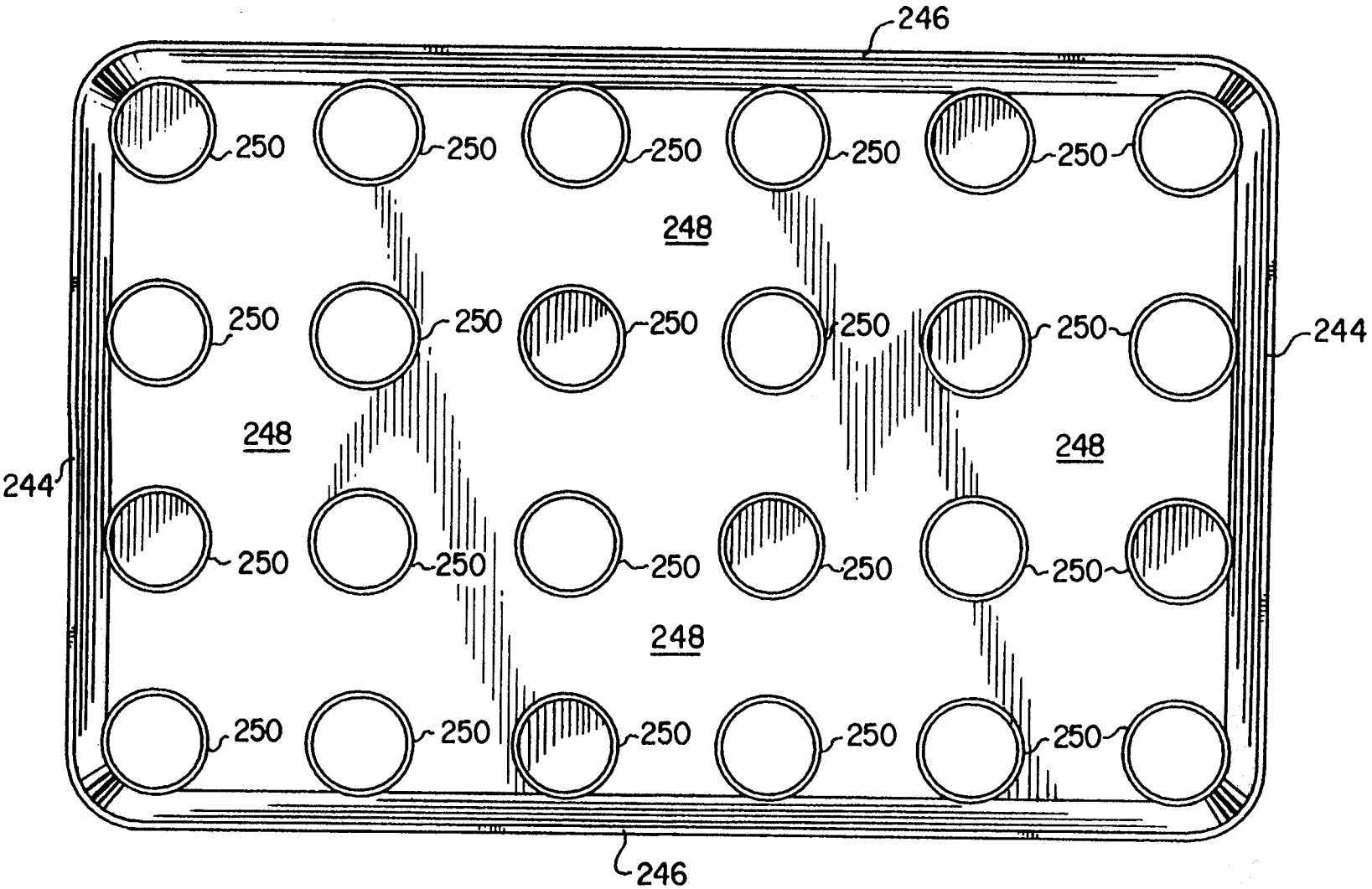
FIG. 16B is a bottom plan view of the cover shown in FIG. 16A.

Cover 204 comprises a lower wall structure 242 and a ceiling 248 disposed thereabove, as illustrated generally in FIGS. 16 and 17. Wall structure 242 is formed from opposing side walls 246 and opposing end walls 244 connected together to thereby form a rectangular structure. Ceiling 248 is connected thereto and disposed above wall structure 242 to generally define an upper planar surface of the case. Similar to cover 104, ceiling 248 includes a plurality of separator rings 250 projecting downwards from the upper planar surface and a plurality of receiving caps 252 projecting upwards therefrom. Separator rings 250 and receiving caps 252 are integrally joined and thereby form openings in the upper surface of ceiling 248. In this manner, bottle tops 107 extend upwards through separator rings 259 and are received and held against further movement by receiving caps 252. Thus, in addition to dividing walls 216 separating adjacent bottles 106 or 108, separator rings 250 and receiving caps 252 also serve to maintain the bottles in an upright and spaced position. Wall structure 242 is generally canted corresponding to the tapering necks of bottles 106 or 108. Thus, the bottom surface of cover 204 fits snugly within the wall structure 212 of tray 202 such that receiving caps 252 will be positioned directly beneath receiving areas 224 when case 200 is stacked beneath a similar case.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A stackable case for bottles, comprising:

(a) a low depth tray to hold and separate bottles, said tray comprising:

a pair of opposed side walls having bottom surfaces lying generally in a plane;

a pair of opposed end walls having end portions and bottom surfaces lying generally in a plane, said end walls being integrally joined at said end portions with said side walls to define a tray rectangular structure;

a floor structure secured to and positioned generally within said tray rectangular structure, said floor structure defining a support surface for a plurality of bottles positioned within said tray rectangular structure;

said floor structure comprising a plurality of spaced, generally circularly-shaped members, a plurality of dividing walls between adjacent said circularly-shaped members thereby forming a plurality of separate bottle receiving pockets and preventing contact of adjacent bottles, and strut means interconnecting said circularly-shaped members and said dividing walls; and said circularly-shaped members having a bottom surface lying generally in a plane and said dividing walls having a bottom surface lying generally in a plane, said plane of said bottom surface of said dividing walls being spaced a distance below the plane of the bottom surface of said circularly-shaped members such that a plurality of generally circular depressions are thereby formed on a bottom surface of said floor structure;

(b) a cover for said tray comprising:

a pair of opposed side walls having bottom surfaces lying generally in a plane;

a pair of opposed end walls having end portions and bottom surfaces lying generally in a plane, said end walls being integrally joined at said end portions with said side walls to define a cover rectangular structure;

a ceiling structure secured to and positioned generally within said cover rectangular structure, said ceiling structure defining a generally planar upper surface; and said ceiling structure comprising a plurality of generally circular separator rings projecting downwards from said upper surface and a plurality of generally circular receiving caps projecting upwards from said upper surface, each of said separator rings being joined with one of said receiving caps thereby forming an opening in said upper surface for receiving the tops of bottles; and wherein said cover is disposed over and exterior to said side walls of said tray when said tray is loaded with bottles such that each of the bottle tops is engaged by one of said receiving caps of said cover and lateral movement of the bottles is thereby substantially prevented.

2. The stackable case of claim 1 wherein said tray and said cover completely enclose the bottles from external light such that deterioration of the contents of the bottles due to light is prevented.

3. The stackable case of claim 1 wherein said dividing walls have approximately the same height as said side walls and said end walls.

4. The stackable case of claim 1 wherein said circularly-shaped members of said floor structure, said separator rings of said ceiling structure and said receiving caps of said ceiling structure are arranged in longitudinal and lateral rows.

5. The stackable case of claim 1 wherein said floor structure further includes twenty-four of said bottle receiving pockets each having a circularly-shaped member on the bottom thereof to support the bottle.

6. The stackable case of claim 5 wherein said circularly-shaped members of said floor structure, said separator rings of said ceiling structure and said receiving caps of said ceiling structure are arranged in four two-by-three arrays corresponding to four six-packs of bottles.

7. The stackable case of claim 1 wherein said floor structure is formed as an open gridwork construction including said circularly-shaped members, said bottom surfaces of said dividing walls, and said strut means.

8. The stackable case of claim 1 wherein said side walls and end walls of said cover further include a lower generally vertical portion and an upper inwardly canted portion.

9. The stackable case of claim 8 wherein said upper ceiling structure defines an area smaller that an area defined by a bottom surface of said cover rectangular structure.

10. The stackable case of claim 1 wherein said circular depressions on said bottom surface of said tray locate said receiving caps of said cover of a corresponding subjacent tray when a plurality of cases are stacked on one another.

11. The stackable case of claim 1 wherein said bottle receiving compartments formed by said dividing walls can at least receive bottles having a first diameter and a second lesser diameter and a first height and a second lesser height, respectively.

12. The stackable case of claim 11 wherein said cover extends further over said side walls of said tray when bottles of said second lesser height are disposed in said tray.

13. The stackable case of claim 1 further comprising a secondary packaging means secured about said tray of bottles and said cover.

14. The stackable case of claim 13 wherein said secondary packaging means comprises strapping incorporating a handle.

15. The stackable case of claim 13 wherein said secondary packaging means comprises a shrink-wrap.

16. A stackable case for bottles, comprising:

(a) a low depth tray to hold and separate bottles, said tray comprising:

a pair of opposed side walls having bottom surfaces lying generally in a plane;

a pair of opposed end walls having end portions and bottom surfaces lying generally in a plane, said end walls being integrally joined at said end portions with said side walls to define a tray rectangular structure;

a floor structure secured to and positioned generally within said tray rectangular structure, said floor structure defining a support surface for a plurality of bottles positioned within said tray rectangular structure;

said floor structure comprising a plurality of spaced, generally circularly-shaped members, a plurality of dividing walls between adjacent said circularly-shaped members thereby forming a plurality of separate bottle receiving pockets and preventing contact of adjacent bottles, and strut means interconnecting said circularly-shaped members and said dividing walls; and said circularly-shaped members having a bottom surface lying generally in a plane and said dividing walls having a bottom surface lying generally in a plane, said plane of said bottom surface of said dividing walls being spaced a distance below the plane of the bottom surface of said circularly-shaped members such that a plurality of generally circular depressions are thereby formed on a bottom surface of said floor structure;

(b) a cover for said tray comprising:

a pair of opposed side walls having bottom surfaces lying generally in a plane;

a pair of opposed end walls having end portions and bottom surfaces lying generally in a plane, said end walls being integrally joined at said end portions with said side walls to define a cover rectangular structure; and a ceiling structure secured to and positioned generally within said cover rectangular structure, said ceiling structure defining a generally planar upper surface, said ceiling structure comprising a plurality of generally circular separator rings projecting downwards from said upper surface and a plurality of generally circular receiving caps projecting upwards from said upper surface, each of said separator rings being joined with one of said receiving caps thereby forming an opening through said upper surface for receiving the tops of bottles; and wherein said cover is disposed over the tops of bottles and inside of said side walls of said tray when said tray is loaded with bottles such that each of the bottle tops is engaged by one of said receiving caps of said cover and lateral movement of the bottles is thereby substantially prevented.

17. The stackable case of claim 16 wherein said tray and said cover completely enclose the bottles from external light such that deterioration of the contents of the bottles due to light exposure is prevented.

18. The stackable case of claim 16 wherein said side and end walls extend above said dividing walls.

19. The stackable case of claim 18 wherein said circularly-shaped members of said floor structure, said separator rings of said ceiling structure and said receiving caps of said ceiling structure are arranged in longitudinal and lateral rows.

20. The stackable case of claim 16 wherein said end walls further include a handle opening therethrough, said handle opening being disposed above the height of said dividing walls.

21. The stackable case of claim 16 wherein said floor structure further includes twenty-four of said bottle receiving pockets, each having a circularly-shaped member on the bottom thereof to support the bottle.

22. The stackable case of claim 21 wherein said circularly-shaped members of said floor structure, said separator rings of said ceiling structure and said receiving caps of said ceiling structure are arranged in four two-by-three arrays corresponding to four six-packs of bottles.

23. The stackable case of claim 16 wherein said floor structure is formed as an open gridwork construction including said circularly-shaped members, said bottom surfaces of said dividing walls, and said strut means.

24. The stackable case of claim 16 wherein said side walls and end walls of said cover are canted inwardly.

25. The stackable case of claim 24 wherein said upper ceiling structure defines an area smaller than an area defined by a bottom surface of said cover rectangular structure.

26. The stackable case of claim 16 wherein said circular depressions on said bottom surface of said tray locate said receiving caps of said cover of a corresponding subjacent tray when a plurality of cases are stacked on top of one another.

27. The stackable case of claim 16 wherein said bottle receiving compartments formed by said dividing walls can at least receive bottles having a first diameter and a second lesser diameter and a first height and second lesser height, respectively.

28. The stackable case of claim 27 where said cover extends further down within said side walls of said tray when bottles of the second lesser height are disposed in said tray.

29. A cover for a tray of bottles, comprising:

a pair of opposed side walls having bottom surfaces lying generally in a plane and having a height defining a cover height;

a pair of opposed end walls having end portions and bottom surfaces lying generally in a plane and having a height substantially equal to said side walls, said end walls being integrally joined at said end portions with said side walls to define a cover rectangular structure; and a ceiling structure secured to and positioned generally within said cover rectangular structure, said ceiling structure defining a generally planar upper surface;

wherein said ceiling structure comprises a plurality of generally circular separator rings projecting downwards from said upper surface and a plurality of generally circular receiving caps projecting upwards from said upper surface, each of said separator rings being joined with one of said receiving caps, to thereby form an opening through said upper surface for receiving the tops of bottles;

wherein said cover height is generally greater than one half the height of bottles received by said receiving caps such that when said cover is disposed over a tray loaded with bottles, said cover extends downwards over and thereby covers more than half of each of the bottles therein; and wherein when said cover is disposed over a tray loaded with bottles each of the bottle tops is engaged by one of said receiving caps of said cover and lateral movement of the bottles is thereby substantially prevented.

30. The cover of claim 29 wherein said separator rings and said receiving caps of said ceiling structure are arranged in longitudinal and lateral rows.

31. The cover of claim 29 wherein said separator rings and said receiving caps of said ceiling structure are arranged in four two-by-three arrays corresponding to four six-packs of bottles.

32. The cover of claim 29 wherein said side walls and end walls of said cover further include a lower generally vertical portion and an upper inwardly canted portion.

33. The cover of claim 32 wherein said upper ceiling structure defines an area smaller than an area defined by a bottom surface of said cover rectangular structure.

34. The cover of claim 29 wherein said side and end walls are disposed exterior to and over a tray of bottles.

35. The cover of claim 29 wherein said side and end walls are disposed interior to and within a tray of bottles.

36. A bottle case comprising:

a tray having a floor structure and upward walls connected thereto, said floor structure having a plurality of bottle support areas on an upper surface thereof and a plurality of upward recesses on a lower surface thereof; and a tray cover positionable in a covering position over bottles supported on said support areas, said tray cover having a cover top structure and downward walls connected thereto, said top structure having a top side and a bottom side, said top structure having on said bottom side a plurality of downward receivers in which the tops of the bottles on said support areas are received when said tray cover is in the covering position, and said top structure including on said top side a plurality of protuberances, said protuberances being positioned to lockingly fit in the upward recesses on the lower surface of a similar stackable bottle tray stacked on said tray cover.

37. The bottle case of claim 36 wherein said tray includes a plurality of dividing walls extending longitudinally and laterally to thereby form a plurality of bottle pockets.

38. The bottle case of claim 37 wherein said bottle pockets generally correspond with said bottle support areas.

39. The bottle case of claim 37 wherein said downward receivers form circular sockets for receiving the tops of bottles disposed in said bottle pockets when said cover is in the covering position.

40. The bottle case of claim 36 wherein said downward receivers and said corresponding protuberances form circular sockets in which the tops of the bottles on said support areas are received when said tray cover is in the covering position.

41. The bottle case of claim 36 wherein at least two of said downward walls of said tray cover include handle openings.

42. The bottle case of claim 36 wherein said tray and said tray cover are formed by injection molding a plastic material.

43. The bottle case of claim 42 wherein said plastic material is a high density polyethylene.

44. A stackable bottle crate system comprising:

a bottom first case including a first tray and a first tray cover;

said first tray having a floor structure and upward walls connected thereto, said floor structure having a plurality of bottle support areas on an upper surface thereof and a plurality of upward recesses on a lower surface thereof;

a plurality of bottles disposed on said bottle support areas of said first tray;

said first tray cover being positionable in a covering position over said plurality of bottles supported on said support areas of said first tray, said first cover having a top structure including an upper surface and a lower surface, said upper surface of said tray cover having a plurality of protuberances;

a top second case including a second tray and a second tray cover;

said second tray having a floor structure and upward walls connected thereto, said floor structure having a plurality of bottle support areas on an upper surface thereof and a plurality of upward recesses on a lower surface thereof:

a plurality of bottles disposed on said bottle support areas of said second tray; and said second tray cover being positionable in a covering position over said plurality of bottles supported on said support areas of said second tray, said second cover having a top structure including an upper surface and a lower surface, said upper surface of said second cover top structure having a plurality of protuberances, said protuberances being positioned to lockingly fit in said plurality of upward recesses on said lower surface of said first tray when said first tray is stacked on top of said second tray cover.

45. The bottle crate system of claim 44 wherein said plurality of bottles are long neck bottles.

46. The bottle crate system of claim 44 wherein said first and second cases completely enclose said bottles from external light when said first and second tray covers are positioned in said covering position.

47. The bottle crate system of claim 44 wherein said first and second floor structures have an open gridwork construction.

48. The bottle crate system of claim 47 wherein said open gridwork construction includes a plurality of circularly-shaped members forming said bottle support areas and a strut system interconnecting said circularly-shaped members.

49. The bottle crate system of claim 47 wherein said first and second trays include a plurality of first and second dividing walls, respectively, forming bottle receiving pockets generally corresponding to said bottle support areas.

50. The bottle crate system of claim 49 wherein said first and second dividing walls extend longitudinally and laterally to form said bottle receiving pockets.

51. The bottle crate system of claim 44 wherein said first and second tray cover top structures include a plurality of bottle top sockets on the lower surfaces thereof.

52. The bottle crate system of claim 51 wherein said bottle top sockets are generally aligned with said bottle support areas when said first and second tray covers are positioned in the covering position such that said bottles rest on said bottle support areas and the tops of said bottles are received in and held by said bottle top sockets.

* * * * *